US006071678A

United States Patent [19]

Takeuchi

[11] Patent Number: 6,071,678

[45] **Date of Patent: *Jun. 6, 2000**

[54] SILVER HALIDE PHOTOGRAPHIC LIGHT-SENSITIVE MATERIAL AND METHOD FOR FORMING AN IMAGE

[75] Inventor: Kiyoshi Takeuchi, Minami-ashigara, Japan

[73] Assignee: Fuji Photo Film Co., Ltd., Kanagawa-ken, Japan

[ * ] Notice: This patent is subject to a terminal disclaimer.

[21] Appl. No.: 09/144,330

[22] Filed: Aug. 31, 1998

Related U.S. Application Data

[62] Division of application No. 08/908,681, Aug. 7, 1997, Pat. No. 5,851,745.

[30] Foreign Application Priority Data

Aug. 14, 1996 [JP] Japan ..... 8-214885

[51] Int. Cl.[7] ..... G03C 7/407

[52] U.S. Cl. ..... 430/348; 430/349; 430/351; 430/448

[58] Field of Search ..... 430/348, 349, 430/351, 448

[56] References Cited

U.S. PATENT DOCUMENTS

| | | | |
|---|---|---|---|
| 5,667,945 | 9/1997 | Takeuchi et al. | 430/351 |
| 5,683,853 | 11/1997 | Makuta et al. | 430/264 |
| 5,756,275 | 5/1998 | Takizawa et al. | 430/224 |
| 5,780,210 | 7/1998 | Takeuchi et al. | 430/264 |
| 5,858,629 | 1/1999 | Ishikawa et al. | 430/380 |

FOREIGN PATENT DOCUMENTS

| | | |
|---|---|---|
| 0 545491A1 | 6/1993 | European Pat. Off. . |
| 8-28630 | 11/1996 | Japan . |
| 8-286340 | 11/1996 | Japan . |

*Primary Examiner*—Hoa Van Le
*Attorney, Agent, or Firm*—Sughrue, Mion, Zinn, Macpeak & Seas, PLLC

[57] ABSTRACT

There is disclosed a silver halide photographic light-sensitive material that contains at least one color-developing agent of formula (I) and at least one dye-forming coupler of formula (II) contained in one or more photographic constitutional layers provided on a base:

formula (I)

formula (II)

$(Y^1)_n$—M—G—$(Y^2)_m$ in formula (I), Z is a carbamoyl group or the like, and Q represents a group of atoms required to form an unsaturated ring together with the C, and in formula (II), M represents a coupler component capable of causing coupling reaction at the site where G is bonded with the oxidized color-developing agent, G is a hydrogen atom or a coupling split-off group, $Y^1$ and $Y^2$ each represent a group having a dissociation group, whose pKa is 1 or more but 12 or less, and n and m are each an integer of 0 to 3, provided that $n+m \geqq 1$. There is also disclosed an image-forming method using the light-sensitive material. According to the use of the novel color-developing agent and the coupler having a dissociation group, an image excellent in maximum color density can be provided.

30 Claims, No Drawings

SILVER HALIDE PHOTOGRAPHIC LIGHT-SENSITIVE MATERIAL AND METHOD FOR FORMING AN IMAGE

This is a divisional of application No. 08/908,681 filed Aug. 7, 1997, U.S. Pat. No. 5,851,745 the disclosure of which is incorporated herein by reference.

FIELD OF THE INVENTION

The present invention relates to a color photographic technique. Particularly, the present invention relates to a silver halide photographic light-sensitive material that meets needs for environmental preservation and simple rapid processing, and that is good in color-forming property when subjected to development; and to a method for forming an image by using the same.

BACKGROUND OF THE INVENTION

In color photographic light-sensitive materials, when the photographic material is exposed to light image-wise and then color-developed, an oxidized color developing agent and a coupler are reacted, to form an image. In this system, color reproduction by the subtractive color process is used, and, to reproduce blue, green, and red colors, dye images are formed that are yellow, magenta, and cyan in color, respectively complementary to blue, green, and red.

Color development is accomplished by immersing the light-exposed color photographic light-sensitive material in an aqueous alkali solution in which a color-developing agent is dissolved (a developing solution). However, the color-developing agent in an aqueous alkali solution is unstable and liable to deteriorate with a lapse of time, and there is the problem that the developing solution must be replenished frequently in order to retain stable developing performance. Further, used developing solutions containing a color-developing agent are required to be discarded, and this, together with the above frequent replenishment, creates a serious problem regarding the treatment of used developing solutions that are discharged in large volume. Thus, low-replenishment and reduced discharge of developing solutions are strongly demanded.

One effective measure proposed for realizing low-replenishment and reduced discharge of developing solutions is a method wherein an aromatic primary amine developing agent or its precursor is built in a hydrophilic colloid layer of a color photographic material. Examples of the developing agents that can be built in, include compounds described, for example, in GB-803 783, U.S. Pat. Nos. 3,342,597, 3,719,492, and 4,060,418, GB-1 069 061, West German Patent No. 1 159 758, JP-B-58-14671 ("JP-B" means examined Japanese patent publication) and 58-14672, and JP-A-57-76543 ("JP-A" means unexamined published Japanese patent application) and 59-81643. However, color photographic materials having these aromatic primary amine developing agents or their precursors built therein have a defect that satisfactory color formation is not attained when they are chromogenically developed. Another effective measure proposed is a method wherein a sulfonylhydrazine-type developing agent is built in a hydrophilic colloid layer of a color photographic material, and examples of the color-developing agent that can be built in include compounds described, for example, in EP-A-545 491 (A1) and 565 165 (A1). However, even the developing agents mentioned therein cannot attain satisfactory color formation when color-developed; and further, when, for this sulfonylhydrazine-type developing agent, use is made of a two-equivalent coupler, there is the problem that color formation hardly takes place. In comparison with four-equivalent couplers, two-equivalent couplers have the advantages that stain due to couplers can be reduced, and that the activity of the couplers can be easily adjusted by the substituent.

Accordingly, there is strong need for a technique that can enhance color-formation property in developing an image, and a technique in which two-equivalent couplers can be used.

SUMMARY OF THE INVENTION

An object of the present invention is to provide a light-sensitive material that makes possible a low replenishment rate and a low discharge, that exhibits good color-forming property, and that is improved in dependence on processing temperature (particularly dependence on development temperature).

Another object of the present invention is to provide a method for forming an image that makes possible a low replenishment rate and a low discharge, that exhibits good color-forming property, and that is improved in dependence on processing temperature (particularly dependence on development temperature).

Other and further objects, features, and advantages of the invention will appear more fully from the following description.

DETAILED DESCRIPTION OF THE INVENTION

The objects of the present invention can be attained by the following constitution:

(1) A silver halide photographic light-sensitive material (preferably a silver halide color photographic light-sensitive material) having at least one photographic constitutional layer on a base, wherein one or more of the said photographic constitutional layers contains at least one color-developing agent represented by the following formula (I) and at least one dye-forming coupler represented by the following formula (II) in the same layer or different layers:

formula (I)

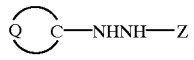

wherein Z represents a carbamoyl group, an acyl group, a sulfamoyl group, an alkoxycarbonyl group, an aryloxycarbonyl group, an amidino group, or an imidoyl group, and Q represents a group of atoms required to form an unsaturated ring together with the C, formula (II)

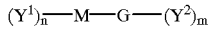

wherein M represents a coupler component capable of causing coupling reaction at the site where G is bonded with the oxidization product of the color-developing agent represented by formula (I), G represents a hydrogen atom or a group capable of coupling split-off by the coupling reaction with the oxidization product of the color-developing agent represented by formula (I), $Y^1$ and $Y^2$ each represent a group having a dissociation group, whose pKa is 1 or more but 12 or less, n and m are each an integer of 0 to 3, provided that $n+m \geqq 1$, and when n and m are each 2 or more, $Y^1$'s and $Y^2$'s are each the same or different.

(2) The silver halide photographic light-sensitive material as stated in the above (1), wherein, in formula (I), Z represents a carbamoyl group, and in formula (II), $Y^1$ and $Y^2$ each represent a group having a dissociation group selected from the group consisting of a —COOH group, an —$NHSO_2$— group, a phenolic hydroxyl group, a —CONHCO— group, a —$CONHSO_2$— group, and an —$SO_2NHSO_2$— group, in which the pKa is 3 or more but 12 or less.

(3) The silver halide photographic light-sensitive material as stated in the above (2), wherein, in formula (II), m is 1 or 2.

(4) A method for forming an image, comprising exposing the silver halide photographic light-sensitive material of the above (1) to light, and subjecting the light-sensitive material to development.

(5) The method for forming an image as stated in the above (4) wherein the silver halide photographic light-sensitive material is subjected to development by heating at 60° C. or higher but 180° C. or lower.

(6) The method for forming an image as stated in the above (4), wherein the silver halide photographic light-sensitive material is subjected to development in a solution.

The compounds represented by formula (I) for use in the present invention is described below in detail.

In formula (I), Z represents a carbamoyl group, an acyl group, a sulfamoyl group, an alkoxycarbonyl group, an aryloxycarbonyl group, an amidino group, or an imidoyl group.

In the present invention, Z in formula (I) is most preferably a carbamoyl group. Preferably the carbamoyl group is a carbamoyl group having 1 to 50 carbon atoms, and more preferably 1 to 40 carbon atoms. Specifically, as the carbamoyl group, —$CONHR_{11}$ is preferable, wherein $R_{11}$ represents preferably a hydrogen atom, an alkyl group, an aryl group, a heterocyclic group, an alkoxy group, an amido group, or an imido group, and more preferably an alkyl group, an aryl group, or a heterocyclic group.

Specific examples include a carbamoyl group, a methylcarbamoyl group, an ethylcarbamoyl group, an isopropylcarbamoyl group, a cyclohexylcarbamoyl group, a t-octylcarbamoyl group, a cyclopropylcarbamoyl group, a dodecyloxycabonylmethylcarbamoyl group, a 3-dodecyloxypropylcarbamoyl group, a 3-(3,5-tetradecyloxyphenoxy)propylcarbamoyl group, a 3-(2,4-t-pentylphenoxy)propylcarbamoyl group, a (2-chloro-5-hexadecyloxycarbonylphenyl)carbamoyl group, a 4-octadecyloxyphenylcarbamoyl group, a 2,4-dimethoxyphenylcarbamoyl group, a 2,5-dichloro-4-dioctylsulfamoylphenylcarbamoyl group, and a dioctylcarbamoyl group.

The acyl group preferably has from 1 to 50 carbon atoms, and more preferably from 2 to 40. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl)propanoyl group.

The sulfamoyl group is preferably a sulfamoyl group having 0 to 50 carbon atoms, and more preferably 0 to 40 carbon atoms. Specific examples include a sulfamoyl group, a methylsulfamoyl group, an isopropylsulfamoyl group, a phenylsulfamoyl group, a dioctylsulfamoyl group, a (2-chloro-5-(2-(2,4-di-t-amylphenoxy)butyryl)aminophenyl)sulfamoyl group, and a 3-methanesulfonylaminophenylsulfamoyl group.

The alkoxycarbonyl group and the aryloxycarbonyl group, respectively, preferably have from 2 to 50 carbon atoms, and more preferably from 2 to 40. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 4-dodecyloxyphenoxycarbonyl group.

The amidino group is preferably an amidino group having 1 to 50 carbon atoms, and more preferably 1 to 40 carbon atoms. Specific examples include an amidino group, a 1-methylamidino group, a 1,1-dibutylamidino group, a 1-phenylamidino group, a 1,3-diisoamylamidino group, and a 1,3-dicyclohexylamidino group.

The imidoyl group is preferably an imidoyl group having 1 to 50 carbon atoms, and more preferably 1 to 40 carbon atoms. Specific examples include a methylimidoyl group, a phenylimidoyl group, an N-acetyldodecyloxyimidoyl group, an N-phenylsulfonylnonylimidoyl group, and a hexadecyloxyimidoyl group.

Q represents a group of atoms required to form an unsaturated ring together with the C, and preferably the unsaturated ring formed by Q and the C includes an aromatic hydrocarbon ring, represented by a benzene ring, a naphthalene ring, or the like, and an unsaturated heterocyclic ring, represented by a pyridine ring, a pyrimidine ring, a thiazole ring, an imidazole ring, a triazole ring, an azaindene ring, and a thiophene ring, or a condensed ring formed by these.

More specifically, in the case of an aromatic hydrocarbon ring, such as a benzene ring and a naphthalene ring, preferably the aromatic hydrocarbon ring is substituted by at least one, preferably 2 to 4, and more preferably 2 to 3, electron-attracting groups, and in the substituents bonded on the ring, preferably the sum of the Hammett sigma constant up values and am values is 0.8 or more but 3.5 or less, and most preferably 1.2 or more but 3.0 or less.

In the case of an unsubstituted heterocyclic ring, various heterocyclic rings can be applied. Examples of the unsaturated heterocyclic ring include preferably azines (e.g. a pyridine ring, a pyrimidine ring, a pyrazine ring, and a triazine ring), azoles (e.g. a pyrrole ring, an imidazole ring, a pyrazole ring, a triazole ring, a tetrazole ring, an oxazole ring, an oxadiazole ring, a thiazole ring, an isothiazole ring, and a thiadiazole ring), a thiophene ring, a furan ring, and a pyran ring.

Besides these, as preferable examples, rings formed by condensation of the above exemplified unsaturated rings can be mentioned. Examples thereof include azanaphthalene rings (e.g. a quinazoline ring, a quinoxaline ring, and a quinoline ring), azaindene rings (e.g. indazole, benzimidazole, 1,3,3a,7-tetraazaindene, and 1,2,3,3a,7-petaazaindene), benzothiazole rings, benzooxazole rings, and benzoisothiazole rings.

Out of these heterocyclic rings, those having at least one electron-attracting group, and preferably 1 to 3 electron-attracting groups, are preferable. Herein the electron-attracting groups are those whose Hammett substituent constant value is positive.

Further, these groups represented by Z or Q may be further substituted with a substituent. Examples of the substituent include a straight-chain or branched, chain or cyclic alkyl group having 1 to 40 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl and dodecyl), a straight-chain or branched, chain or cyclic alkenyl group having 2 to 40 carbon atoms (e.g. vinyl, 1-methylvinyl, and cyclohexene-1-yl), an alkynyl group having 2 to 40 total carbon atoms (e.g. ethynyl and 1-propynyl), an aryl group having 6 to 40 carbon atoms (e.g. phenyl, naphthyl, and anthryl), an acyloxy group having 1 to 40 carbon atoms (e.g. acetoxy, tetradecanoyloxy, and benzoyloxy), a carbamoyloxy group having 1 to 40 carbon atoms (e.g. N,N-dimethylcarbamoyloxy), a carbonamide group having 1 to 40 carbon atoms (e.g. formamide, N-methylacetoamide, acetoamide, N-methylformamide, and benzamide), a sulfonamide group having 1 to 40 carbon atoms (e.g. methanesulfonamide, dodecanesulfonamide, benzenesulfonamide, and p-toluenesulfonamide), a carbamoyl group having 1 to 40 carbon atoms (e.g. N-methylcarbamoyl, N,N-diethylcarbamoyl, and N-mesylcarbamoyl), a sulfamoyl group having 0 to 40 carbon atoms (e.g. N-butylsulfamoyl, N,N-diethylsulfamoyl, N-methyl-N-(4-methoxyphenyl) sulfamoyl), an alkoxy group having 1 to 40 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 40 carbon atoms (e.g. phenoxy, 4-methoxyphenoxy, and naphthoxy), an aryloxycarbonyl group having 7 to 40 carbon atoms (e.g. phenoxycarbonyl and naphthoxycarbonyl), an alkoxycarbonyl group having 2 to 40 carbon atoms (e.g. methoxycarbonyl and t-butoxycarbonyl), an N-acylsulfamoyl group having 1 to 40 carbon atoms (e.g. N-tetradecanoylsulfamoyl and N-benzoylsulfamoyl), an alkylsulfonyl group having 1 to 40 carbon atoms (e.g. methanesulfonyl, octylsulfonyl, 2-methoxyethylsulfonyl and 2-hexyldecylsulfonyl), an arylsulfonyl group having 6 to 40 carbon atoms (e.g. benzenesulfonyl, p-toluenesulfonyl, and 4-phenylsulfonylphenylsulfonyl), an alkoxycarbonylamino group having 2 to 40 carbon atoms (e.g. ethoxycarbonylamino), an aryloxycarbonylamino group having 7 to 40 carbon atoms (e.g. phenoxycarbonylamino and naphthoxycarbonylamino), an amino group having 0 to 40 carbon atoms (e.g. amino, methylamino, diethylamino, diisopropylamino, anylino, and morpholino), a cyano group, a nitro group, a carboxyl group, a hydroxyl group, a sulfo group, a mercapto group, an alkylsulfinyl group having 1 to 40 carbon atoms (e.g. methanesulfinyl and octanesulfinyl), an arylsulfinyl group having 6 to 40 carbon atoms (e.g. benzenesulfinyl, 4-chlorophenylsulfinyl, and p-toluenesulfinyl), an alkylthio group having 1 to 40 carbon atoms (e.g. methylthio, octylthio, and cyclohexylthio), an arylthio group having 6 to 40 carbon atoms (e.g. phenylthio and naphthylthio), a ureido group having 1 to 40 carbon atoms (e.g. 3-methylureido, 3,3-dimethylureido, and 1,3-diphenylureido), a heterocyclic group having 2 to 40 carbon atoms (a 3- to 12-membered monocyclic or condensed ring containing, for example, at least one nitrogen, oxygen, or sulfur as hetero atom, e.g. 2-furyl, 2-pyranyl, 2-pyridyl, 2-thienyl, 2-imidazolyl, morpholino, 2-quinolyl, 2-benzimidazolyl, 2-benzothiazolyl and 2-benzooxazolyl), an acyl group having 1 to 40 carbon atoms (e.g. acetyl, benzoyl and trifluoroacetyl), a sulfamoylamino group having 0 to 40 carbon atoms (e.g. N-butylsulfamoylamino and N-phenylsulfamoylamino), a silyl group having 3 to 40 carbon atoms (e.g. trimethylsilyl, dimethyl-t-butylsilyl and triphenylsilyl) and a halogen atom (e.g. fluorine atom, chlorine atom, and bromine atom).

The total number of carbon atoms of the compound represented by formula (I) is preferably 1 or more but 80 or below, more preferably 2 or more but 60 or below, and most preferably 3 or more but 50 or below.

Herein, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

Now, specific examples of the color-developing agent represented by formula (I) used in the present invention are described below, but the scope of the present invention is not limited to them.

I-1

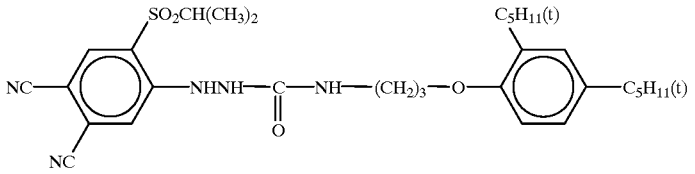

I-2

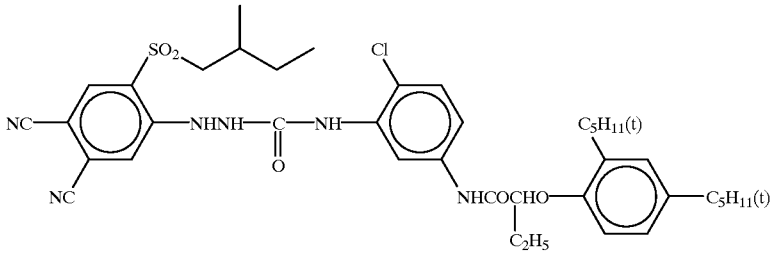

-continued
I-3
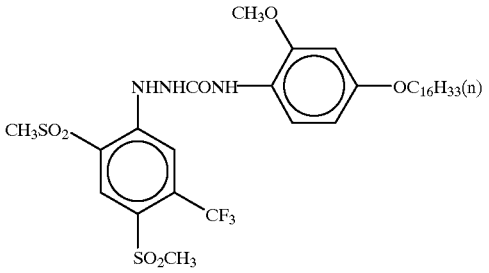
I-4
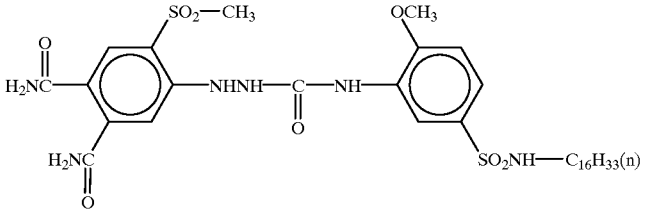
I-5
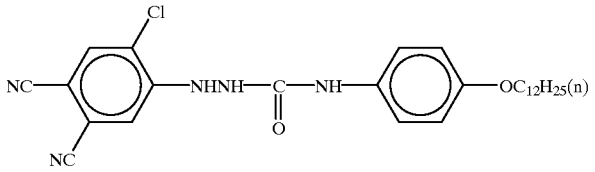
I-6
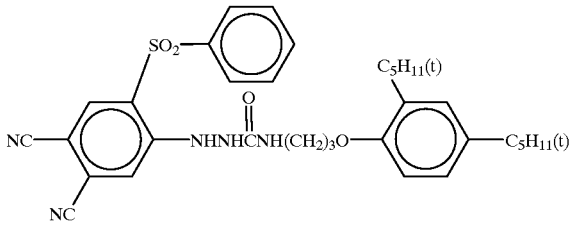
I-7
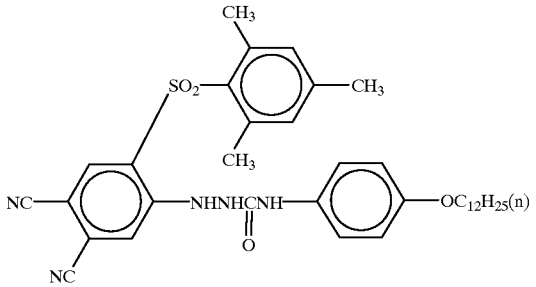
I-8
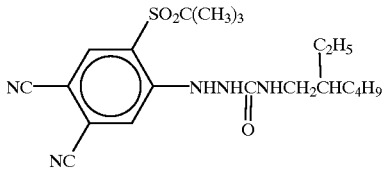
I-9
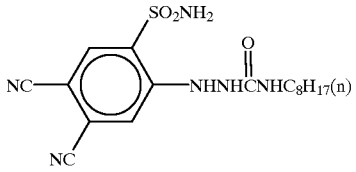

-continued
I-10
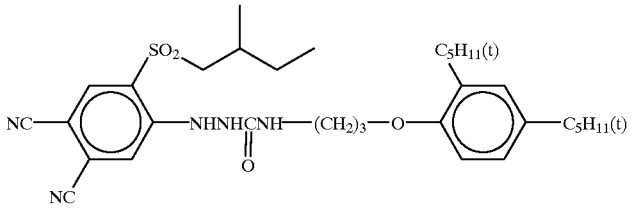
I-11
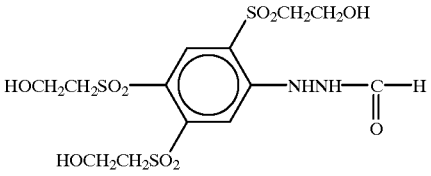
I-12
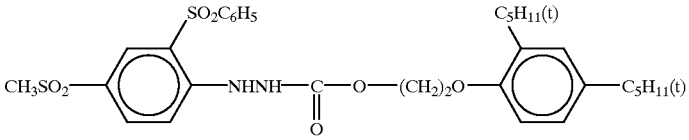
I-13
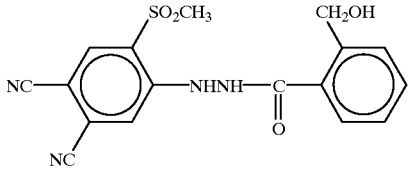
I-14
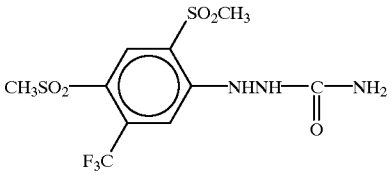
I-15
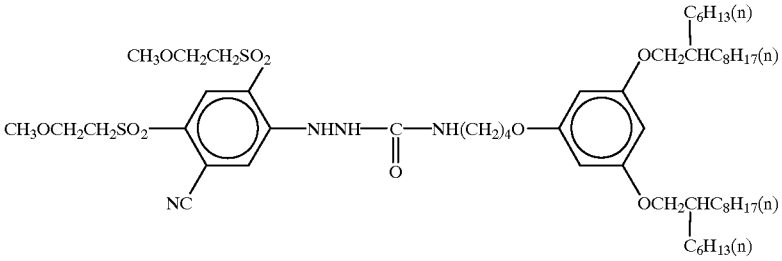
I-16
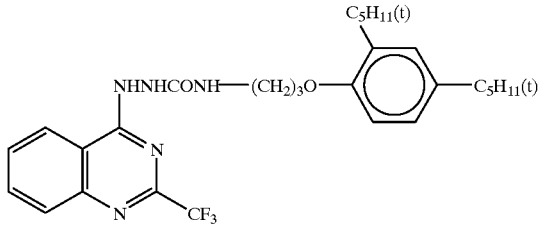

-continued
I-17
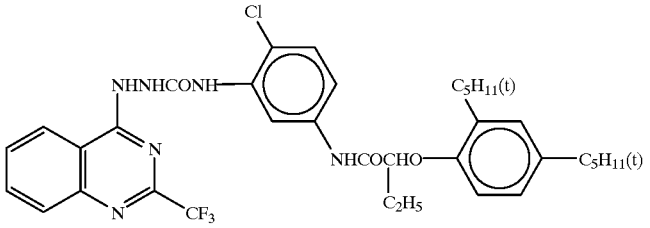
I-18
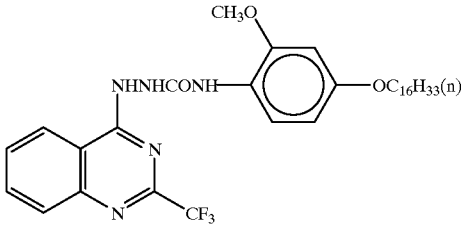
I-19
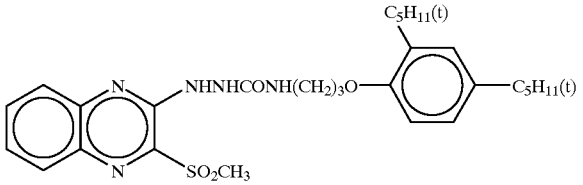
I-20
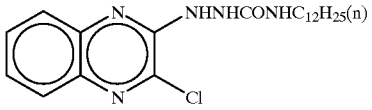
I-21
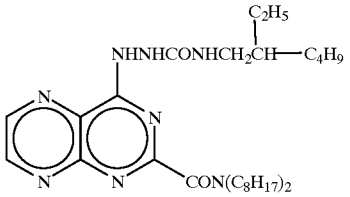
I-22
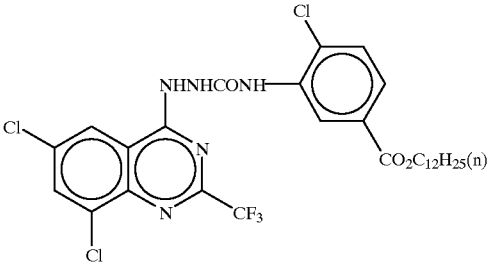
I-23
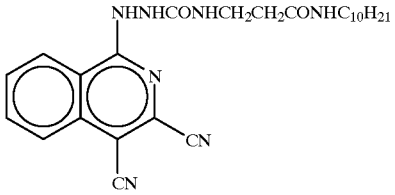

-continued
I-24
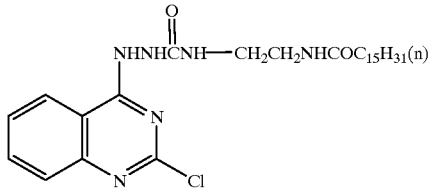
I-25
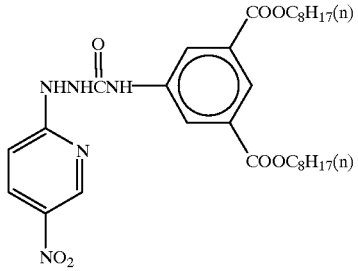
I-26
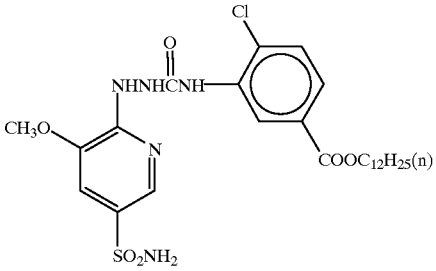
I-27
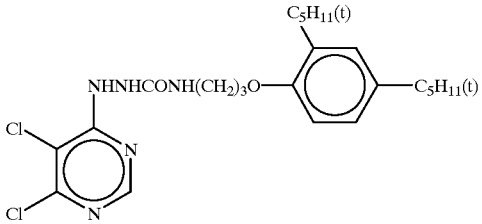
I-28
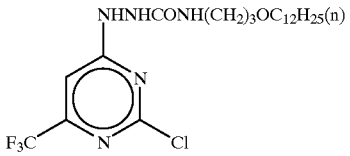
I-29
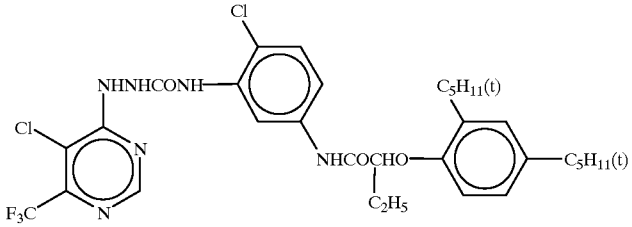

-continued
I-30
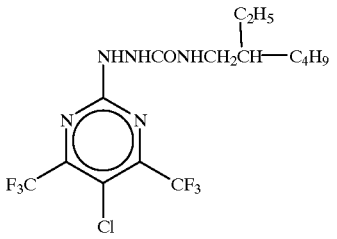
I-31
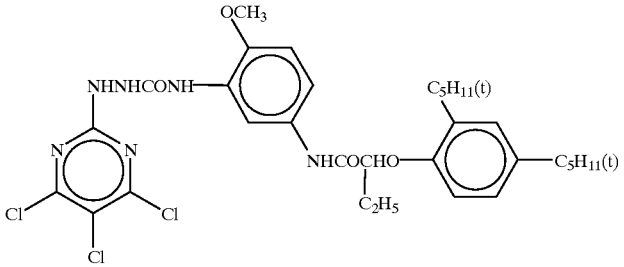
I-32
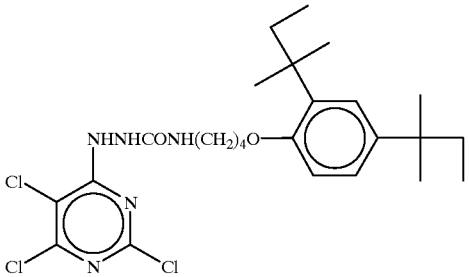
I-33
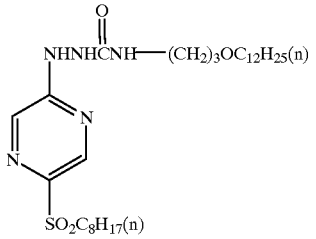
I-34
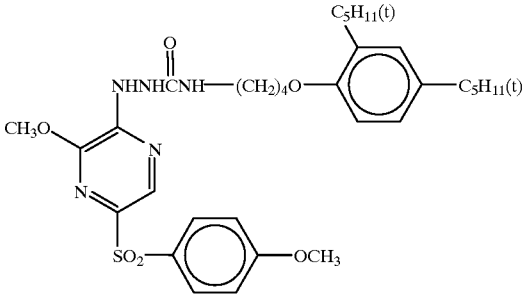
I-35
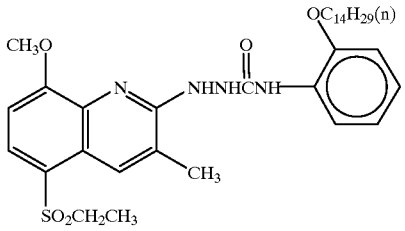

-continued
I-36
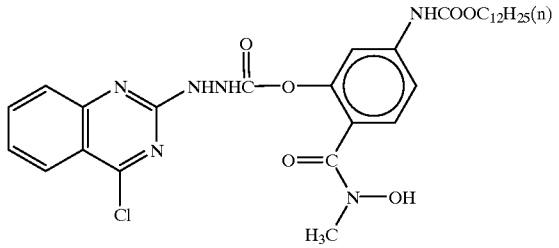
I-37
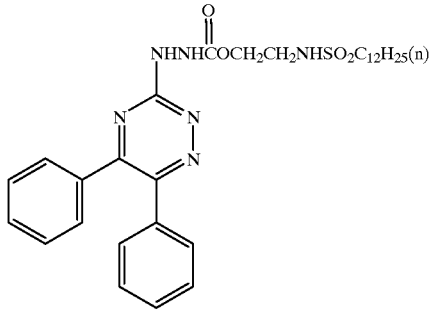
I-38
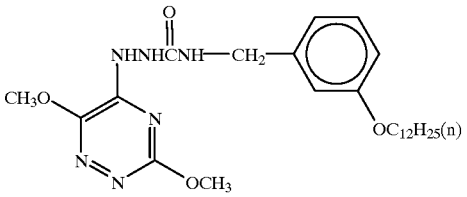
I-39
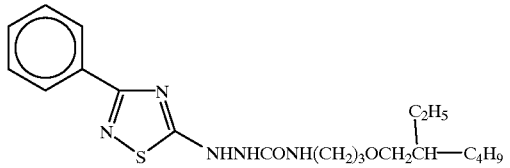
I-40
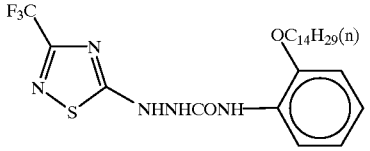
I-41
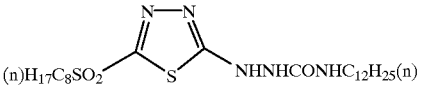
I-42
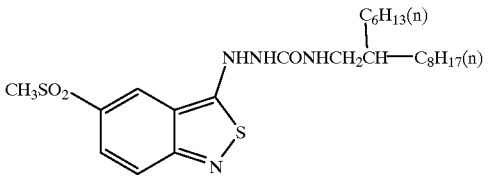
I-43
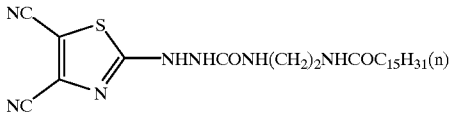

-continued
I-44
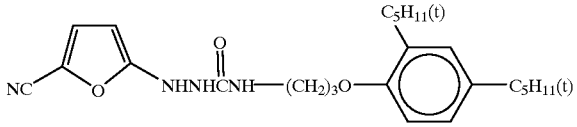
I-45
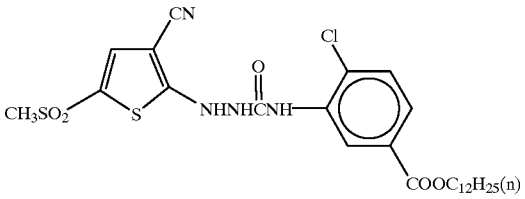
I-46
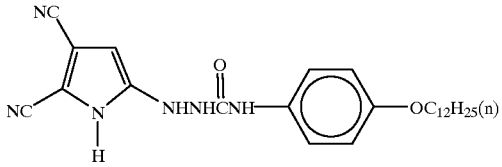
I-47
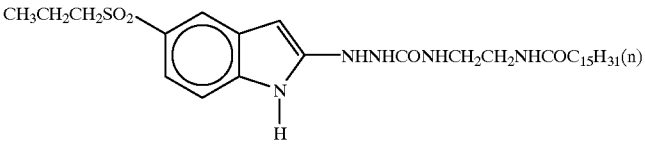
I-48
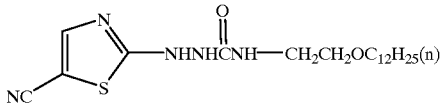
I-49
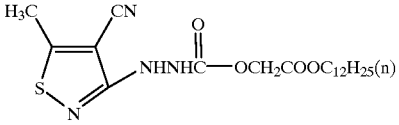
I-50
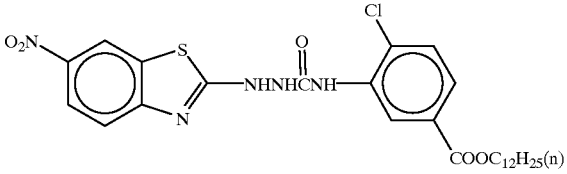
I-51
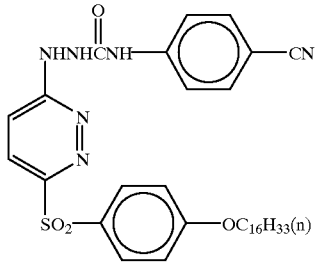

-continued
I-52
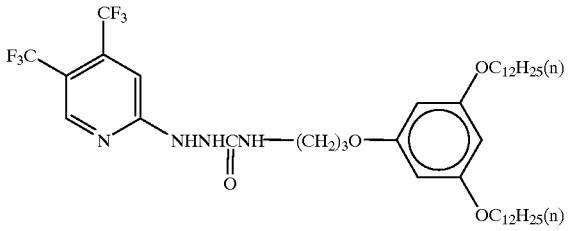
I-53
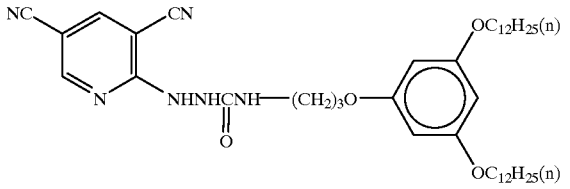
I-54
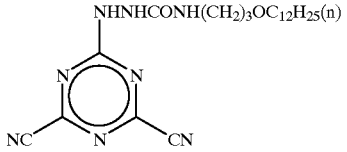
I-55
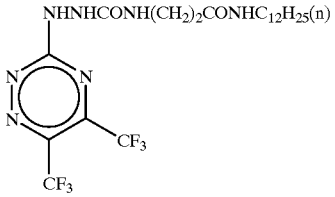
I-56
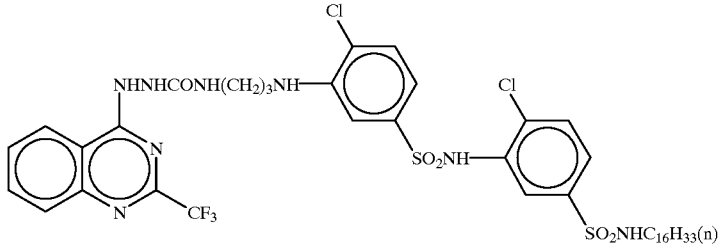
I-57
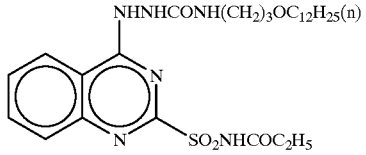
I-58
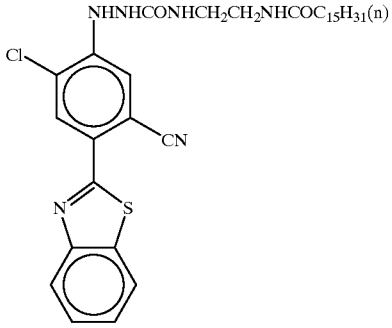

-continued

I-59

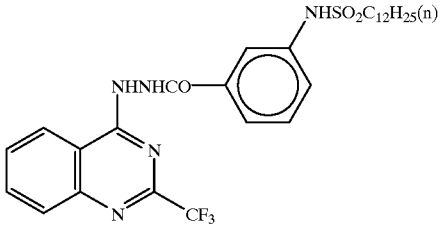

I-60

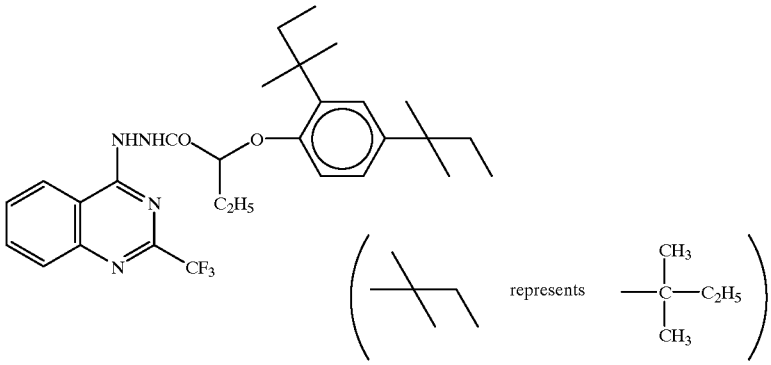

I-61

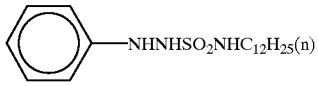

I-62

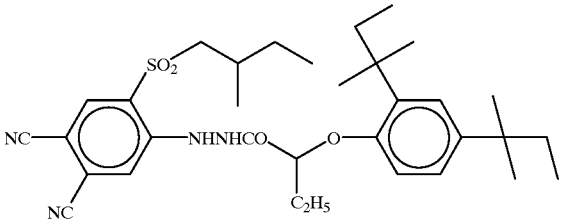

I-63

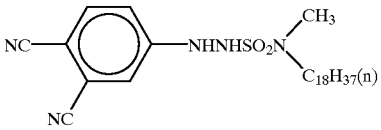

Generally the compound represented by formula (I) used in the present invention can be easily synthesized by reacting a hydrazine, which has a ring moiety formed by the C and Q (e.g. an arylhydrazine or a heterocyclic hydrazine), with, for example, an acid halide, an acid anhydride, or an isocyanate, each of which is an acid moiety represented by Z. Representative synthetic examples are given below. Other compounds can be synthesized similarly to these examples.

Synthetic Example 1

Synthesis of Exemplified Compound (I-10)

The synthesis is carried out by following the below-shown synthesis route:

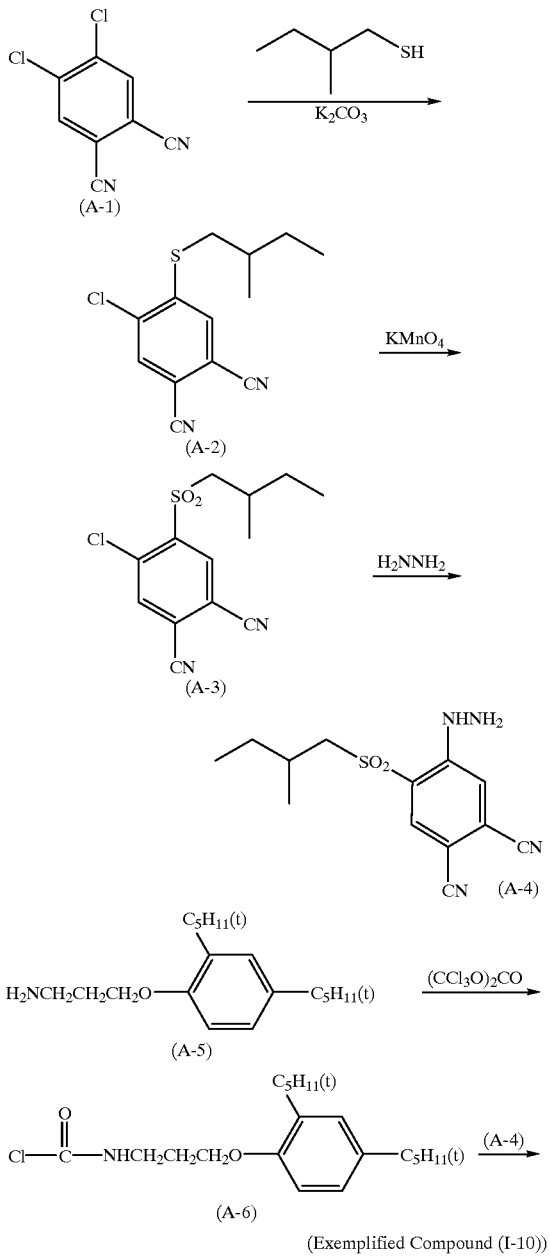

Synthesis of Compound (A-2)

84.7 g of Compound (A-1) (CAS Registry No. 139152-08-2) and 89.8 g of potassium carbonate were suspended in 600 ml of DMF, and then 60.3 ml of 2-methylbutylmercaptan was added, dropwise, to the suspension, at room temperature over 1 hour, followed by stirring at room temperature for 1 hour. The reaction mixture was poured into water and stirred for 10 min. The produced white solid was filtered, washed with water, and dried. Yield: 100.8 g (88.5%).

Synthesis of Compound (A-3)

98.0 g of Compound (A-2) was suspended in 500 ml of acetic acid and 500 ml of water, and to the suspension was added, dropwise, a solution of 88.5 g of potassium permanganate in 500 ml of water, at room temperature over 1 hour, followed by stirring at room temperature for 2 hours. Then 2 liters of water and 2 liters of ethyl acetate were added to the reaction mixture, followed by Celite-filtering. The filtrate was separated, and the organic layer was washed with water, an aqueous hydrosulfite solution, an aqueous sodium bicarbonate solution, and brine, followed by drying over anhydrous magnesium sulfate. After filtering the dried organic layer, the solvent was distilled off, and isopropyl alcohol was added to the residue, to effect crystallization, to obtain 53.2 g of a white solid of Compound (A-3). Yield: 48.4%.

Synthesis of Compound (A-4)

50.0 g of Compound (A-3) was dissolved in 100 ml of DMSO, and then 17.0 g of hydrazine monohydrate was added, dropwise, thereto, over 10 min under cooling with ice, followed by stirring at room temperature for 30 min. The reaction mixture was poured into water, and extraction was carried out with ethyl acetate. The organic layer was washed with water and dried over anhydrous magnesium sulfate. After filtering the dried organic layer, the solvent was distilled off, and the residue was purified by silica gel chromatography, using methylene chloride as an eluent. Crystallization was carried out from ethyl acetate/hexane (1:2), to obtain 31.4 g of a yellow solid of Compound (A-4). Yield: 63.2%.

Synthesis of Exemplified Compound (I-10)

4.6 g of triphosgene was dissolved in 100 ml of THF, and to the solution were added, dropwise, 13.6 g of Compound (A-5) (CAS Registry No. 61053-26-7), at room temperature over 10 min, and then 18.7 ml of triethylamine, at room temperature over 10 min. Reaction was carried out for 30 min, to obtain a solution of Compound (A-6). To this reaction solution was added 13.0 g of Compound (A-4), in portions, at room temperature over 10 min. After the reaction mixture was stirred for a further 1 hour, the reaction mixture was poured into water, and extraction with ethyl acetate was carried out. After the organic layer was washed with an aqueous sodium bicarbonate solution, hydrochloric acid, and then brine, the organic layer was dried over anhydrous magnesium sulfate. After the dried organic layer was filtered, the solvent was distilled off. The residue was purified by silica gel column chromatography, and crystallization from ethyl acetate/hexane 1:10 mixture was carried out, to obtain a white solid of Exemplified Compound (I-10). Yield: 17.0 g (61.3%).

Synthetic Example 2

Synthesis of Exemplified Compound (I-16)

The synthesis was carried out by following the synthesis route given below:

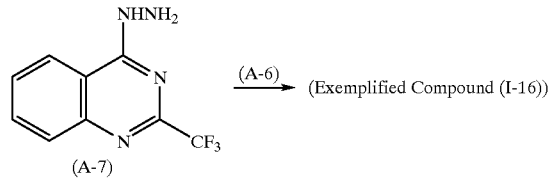

Similarly to Synthetic Example 1, the synthesis was carried out by using Compound (A-6), prepared similarly to Synthetic Example 1 from 5.8 g of Compound (A-5), and 4.3 g of Compound (A-7) (described in EP-A-545 491 (A1)), to obtain a white solid of Exemplified Compound (I-16). Yield: 6.7 g (61.5%).

Now, the compound represented by formula (II) used in the present invention will be described in detail.

The groups represented by $Y^1$ or $Y^2$ are each a group having a dissociation group whose pKa is 1 or more but 12 or less. Herein, the value of pKa represents the acid dissociation constant obtained by dissolving the compound represented by formula (II) in tetrahydrofuran (THF)/water=6/4 (volume ratio) at room temperature.

The pKa of the groups represented by $Y^1$ or $Y^2$ is more preferably 3 or more but 12 or less, and most preferably 5 or more but 11 or less.

Preferable examples of $Y^1$ and $Y^2$ include groups containing a —COOH group, an —$NHSO_2$ group, a phenolic hydroxyl group, a —CONHCO— group, a —$CONHSO_2$— group, or a —CON(R)—OH, —COOH or —$SO_2NHSO_2$— group, with more preference given to a —COOH group, an —$NHSO_2$— group, a phenolic hydroxyl group; a —CONHCO— group, a —$CONHSO_2$— group, or an —$SO_2NHSO_2$— group. R represents a hydrogen atom or a substituent. R is preferably an alkyl group, an aryl group, or a heterocyclic group.

n and m are each an integer of 0 to 3, provided that $n+m \geqq 1$. n is preferably 0, 1, or 2, and more preferably 1 or 2. m is preferably 0, 1, or 2, and more preferably 1 or 2. Preferably n+m is 1 to 3, more preferably $n+m \geqq 2$, and especially preferably n+m=2 or 3.

When n and m are each 2 or more, $Y^1$'s and $Y^2$'s are the same or different, respectively.

The mode of the substitution of $Y^1$ and $Y^2$ on M or G preferably includes an alkyl group, an alkenyl group, an alkynyl group, an aryl group, an acyloxy group, a carbamoyloxy group, a carbonamido group, a sulfonamido group, a carbamoyl group, a sulfamoyl group, an alkoxy group, an aryloxy group, an aryloxycarbonyl group, an alkoxycarbonyl group, an N-acylsulfamoyl group, an alkylsulfonyl group, an arylsulfonyl group, an alkoxycarbonylamino group, an aryloxycarbonylamino group, an amino group, an alkylsulfinyl group, an arylsulfinyl group, an alkylthio group, an arylthio group, a ureido group, a heterocyclic group, an acyl group, a sulfamonylamino group, and a silyl group.

G represents a hydrogen atom or a group that can be split-off upon the coupling reaction with the oxidation product of the developing agent. Examples of G include a heterocyclic group (a saturated or unsaturated, 5- to 7-membered, monocyclic or condensed heterocyclic ring containing at least one hetero atom, such as a nitrogen, oxygen, and sulfur, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxycarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamide group (e.g. methanesulfonamide and benzenesulfonamide), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

G may be substituted by a substituent, and examples of the substituent substituting on G include those mentioned for Z and Q in the above formula (I).

Preferably G is a halogen atom, an aryloxy group, a heterocyclic oxy group, an acyloxy group, an aryloxycarbonyloxy group, an alkoxycarbonyloxy group, or a carbamoyloxy group.

M represents a coupler component that can cause a coupling reaction, at the site at which G is bonded, with the oxidation product of the color-developing agent represented by formula (I).

This coupler may be a so-called "four-equivalent coupler" or "two-equivalent coupler", which is used in a conventional system using a p-phenylenediamine-series developing agent, but in the present invention, a "two-equivalent coupler" is preferable. Specific examples of the coupler are described in detail, for example, in "Theory of The Photographic Process" (4th Ed., edited by T. H. James, Macmillan, 1977), pages 291 to 334 and 354 to 361, and in JP-A-58-12353, 58-149046, 58-149047, 59-11114, 59-124399, 59-174835, 59-231539, 6-231540, 60-2951, 60-14242, 60-23474, and 60-66249.

Examples of couplers that can be preferably used in the present invention are listed below.

As couplers that are preferably used in the present invention, compounds having structures described by the following formulae (1) to (12) are mentioned. They are compounds, in general, collectively called active methylenes, pyrazolones, pyrazoloazoles, phenols, naphthols, and pyrrolotriazoles, respectively, and these compounds are known in the art.

(1)

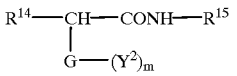

(2)

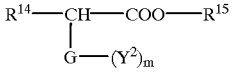

(3)

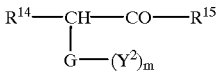

(4)

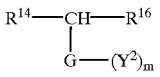

-continued (5)

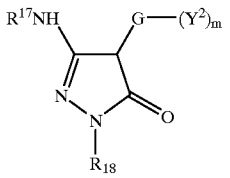

(6)

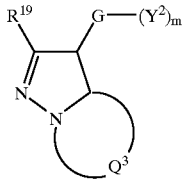

(7)

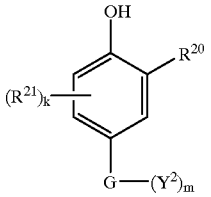

(8)

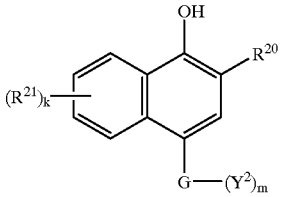

(9)

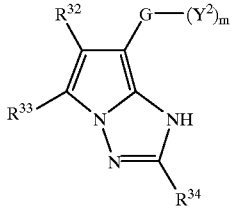

(10)

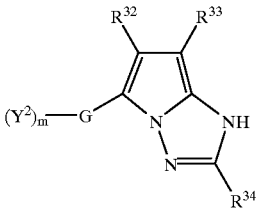

(11)

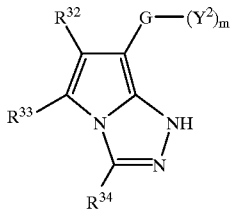

-continued (12)

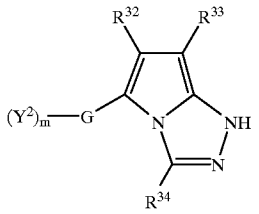

In each of formulae (1) to (12), at least one of $R^{14}$ to $R^{21}$, $Q^3$, and $R^{32}$ to $R^{34}$ represents $Y^1$ in formula (II). G, $Y^2$ and m have the same meanings as defined above.

Formulae (1) to (4) represent couplers that are called active methylene-series couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for the substituent for Z and Q.

Formula (5) represents a coupler that is called a 5-pyrazolone-series coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole-series coupler, and, in the formula, $R^{19}$ represents a hydrogen atom or a substituent. $Q^3$ represents a group of nonmetal atoms required to form a 5-membered azole ring containing 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole-series couplers are pyrazoloazole couplers having a branched alkyl group directly bonded to the 2-, 3-, or 6-position of the pyrazolotriazole group, as described in JP-A-61-65245; pyrazoloazole couplers containing a sulfonamido group in the molecule, as described in JP-A 61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or 63-307453; and pyrazolotriazole couplers having a carbonamido group in the molecule, as described in JP-A-2-201443.

Formulae (7) and (8) are couplers that are respectively called phenol-series couplers and naphthol-series couplers, and in the formulae, $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent. In formulae (7) and (8), $R^{21}$ represents a substituent, k is an integer selected from 0 to 2, and i is an integer selected from 0 to 4. When k and i are 2 or more, $R^{21}$'s may be different. The substituents of $R^{21}$ to $R^{23}$ include those mentioned for the substituent of Z and Q.

Preferable examples of the phenol-series couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol couplers described, for example, in U.S. Pat. No. 3,446,622, 4,333,999, 4,451,559, and 4,427,767.

Preferable examples of the naphthol-series couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889.

Formulas (9) to (12) are couplers called pyrrolotriazoles, and $R^{32}$, $R^{33}$, and $R^{34}$ each represent a hydrogen atom or a substituent. Examples of the substituent of $R^{32}$, $R^{33}$, and $R^{34}$ include those mentioned as examples for the substituent of Z and Q. Preferable examples of the pyrrolotriazole-series couplers represented by formulae (9) to (12) include those wherein at least one of $R^{32}$ and $R^{33}$ is an electron-attracting group, which specific couplers are described in EP-A-488 248 (A1), 491 197 (A1), and EP-545 300.

Further, a fused-ring phenol, an imidazole, a pyrrole, a 3-hydroxypyridine, an active methylene, an active methine, a 5,5-ring-fused heterocyclic, or a 5,6-ring-fused heterocyclic coupler that has a dissociation group as in the above formula (1) to (12), can be used.

As the fused-ring phenol-series couplers, those described, for example, in U.S. Pat. Nos. 4,327,173, 4,564,586, and 4,904,575, having a dissociation group, can be used.

As the imidazole-series couplers, those described, for example, in U.S. Pat. Nos. 4,818,672 and 5,051,347, having a dissociation group, can be used.

As the 3-hydroxypyridine-series couplers, those described, for example, in JP-A-1-315736, having a dissociation group, can be used.

As the active methylene-series and active methine-series couplers, those described, for example, in U.S. Pat. Nos. 5,104,783 and 5,162,196, having a dissociation group, can be used.

As the 5,5-ring-fused heterocyclic couplers, for example, pyrrolopyrazole couplers described in U.S. Pat. Nos. 5,164,289, and pyrroloimidazole couplers described in JP-A-4-174429, each of which has a dissociation group, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in EP-A-556 700, each of which has a dissociation group, can be used.

In the present invention, in addition to the above couplers, use can be made of couplers described, for example, in West Germany Patent Nos. 3 819 051A and 3 823 049, U.S. Pat. Nos. 4,840,883, 5,024,930, 5,051,347, and 4,481,268, EP-A-304 856 (A2), 329 036, 354 549 (A2), 374 781 (A2), 379 110 (A2), and 386 930 (A1), and JP-A-63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732, each of which couplers has a dissociation group.

Specific examples of the coupler represented by formula (II) that can be used in the present invention are shown below, but, of course, the present invention is not limited to them:

(C-1)

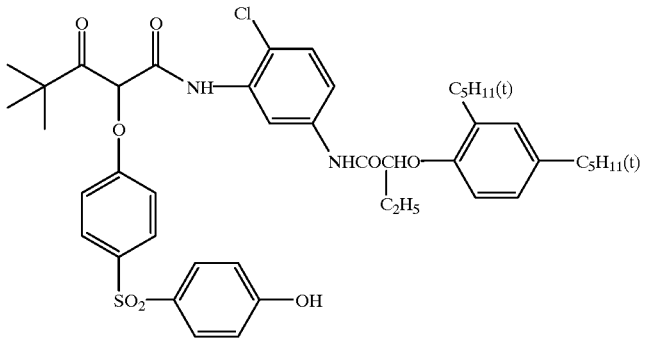

-continued
(C-2)
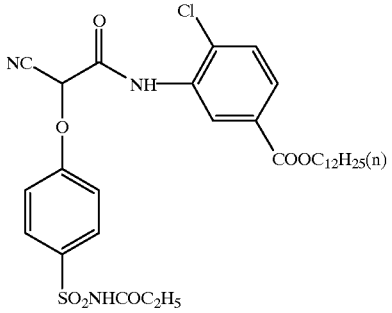
(C-3)
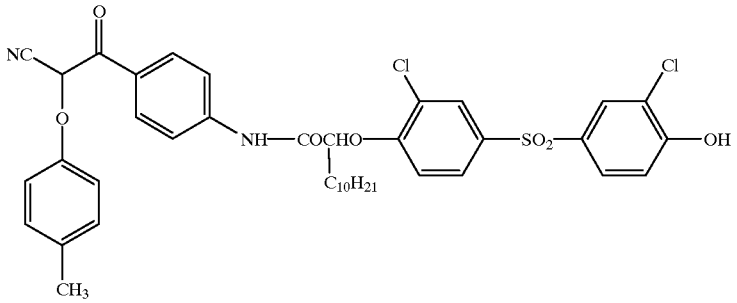
(C-4)
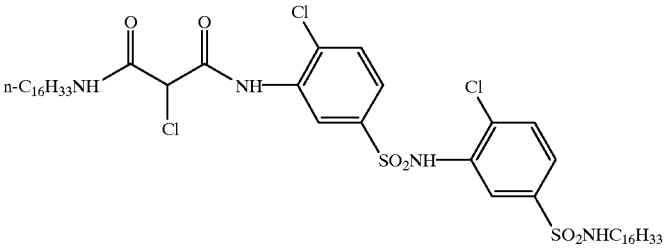
(C-5)
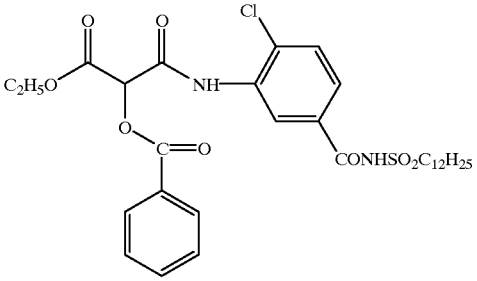
(C-6)
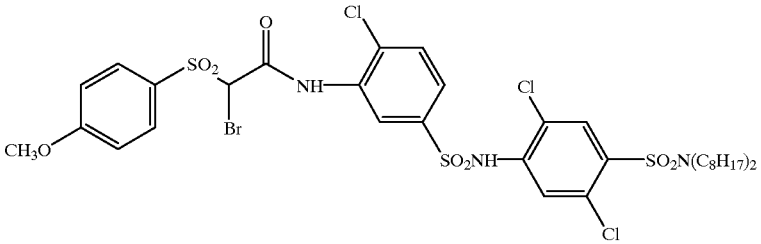

-continued
(C-7)
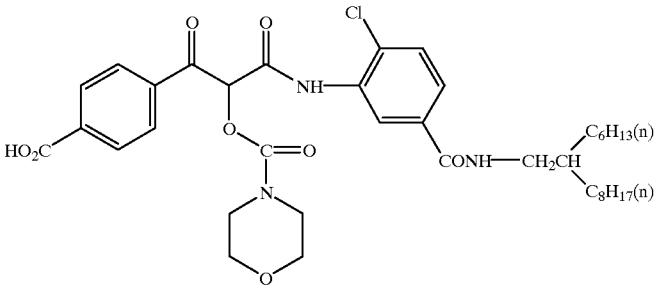
(C-8)
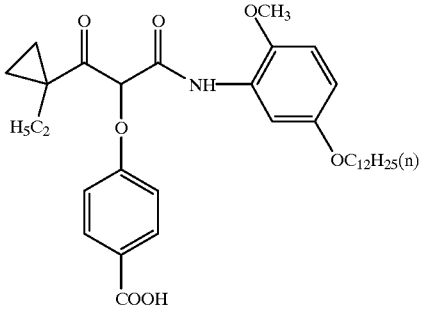
(C-9)
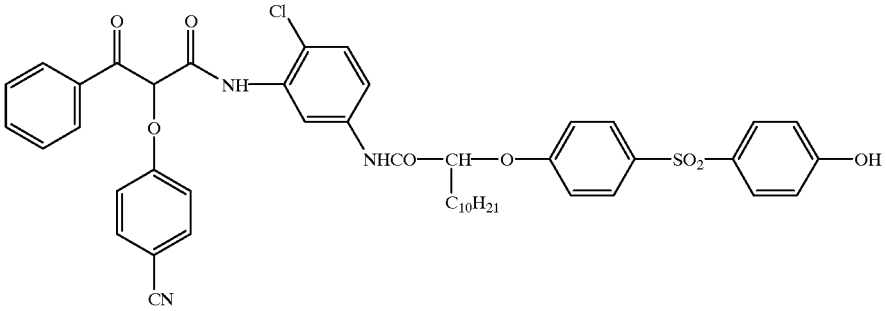
(C-10)
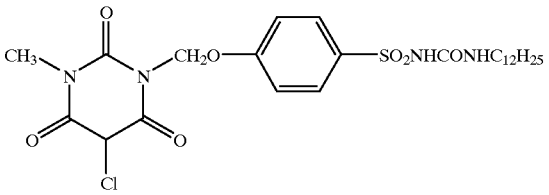
(C-11)
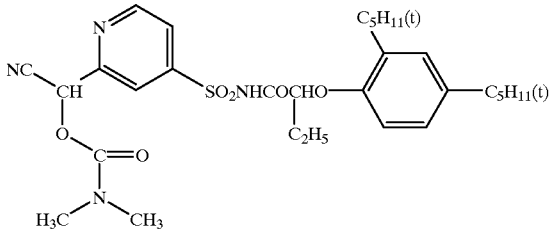

-continued
(C-12)
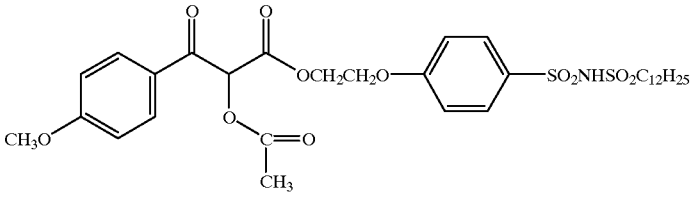
(C-13)
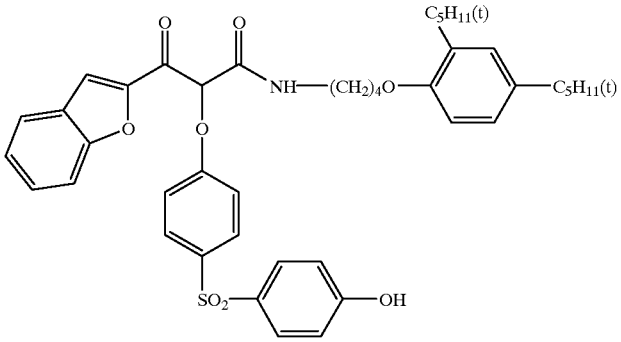
(C-14)
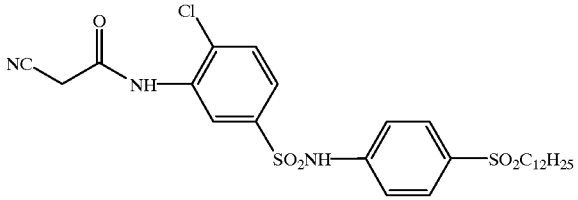
(C-15)
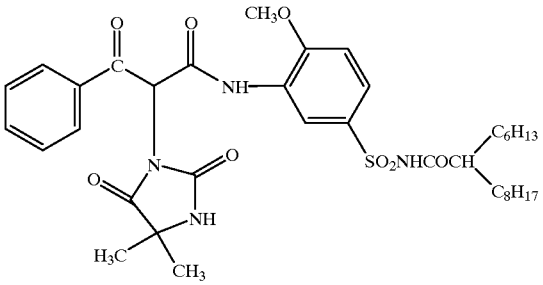
(C-16)
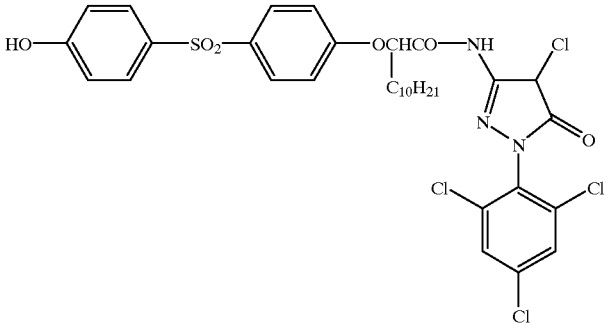

-continued
(C-17)
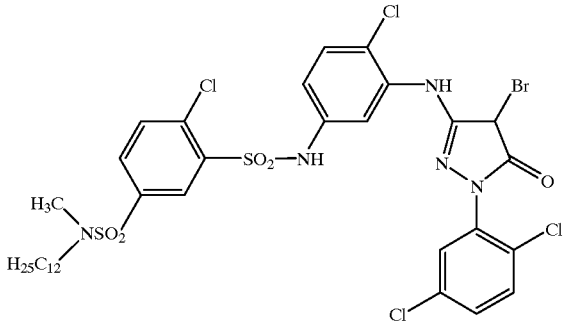
(C-18)
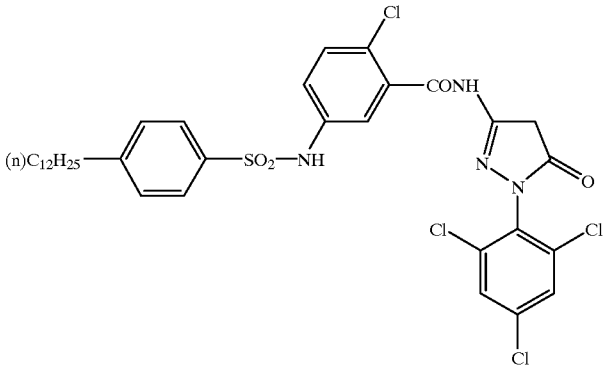
(C-19)
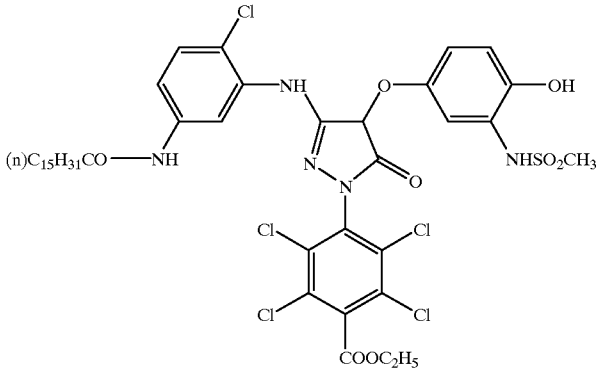
(C-20)
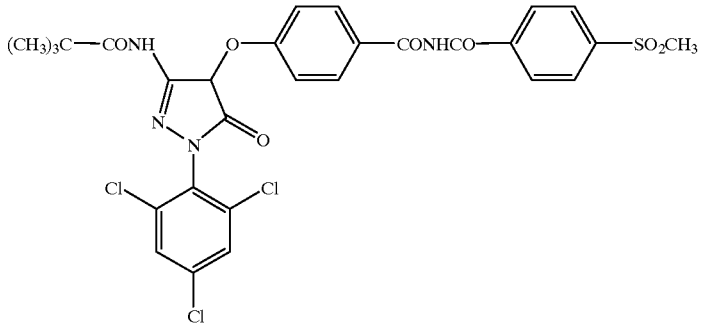

-continued
(C-21)
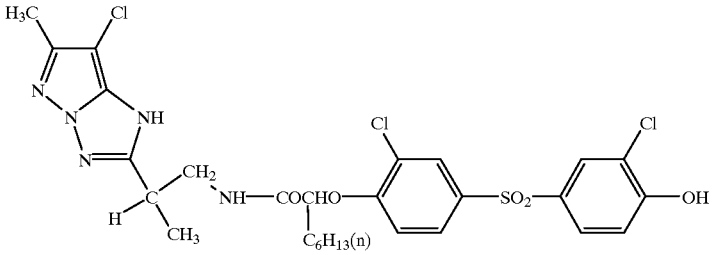
(C-22)
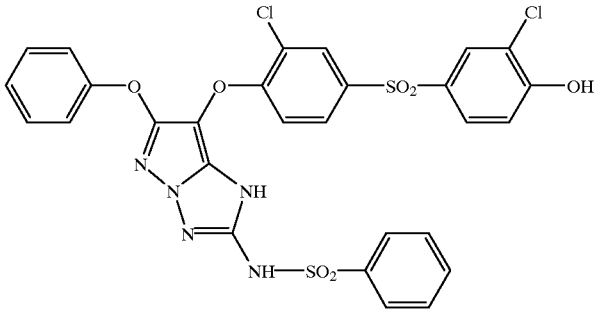
(C-23)
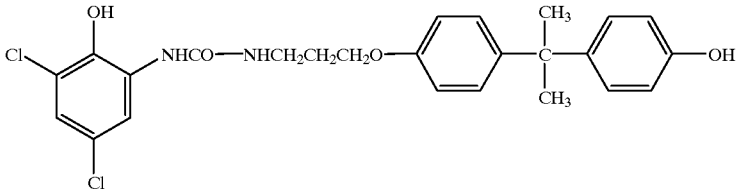
(C-24)
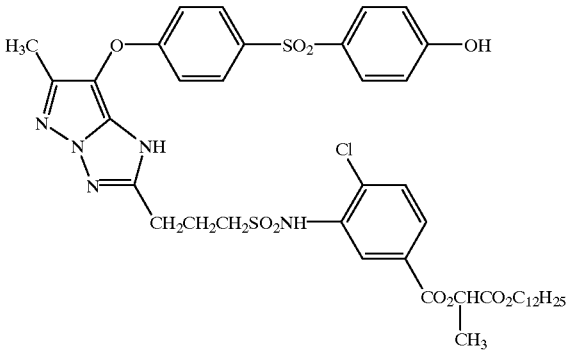
(C-25)
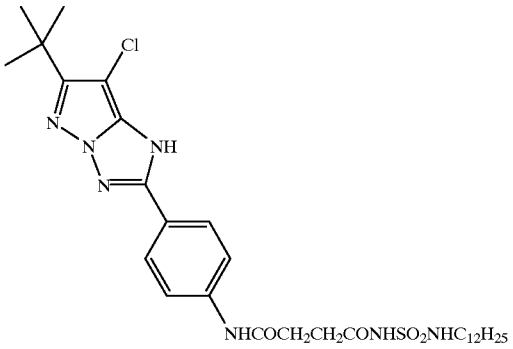

-continued
(C-26)
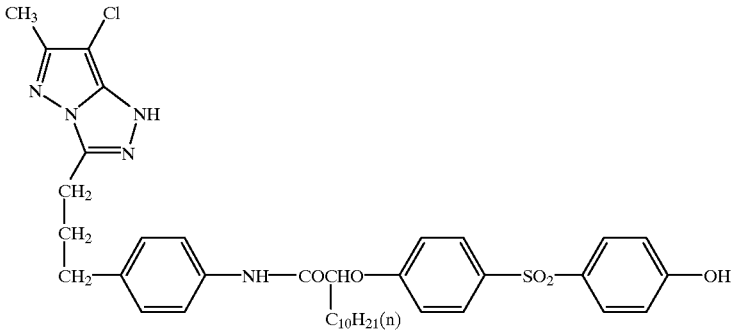
(C-27)
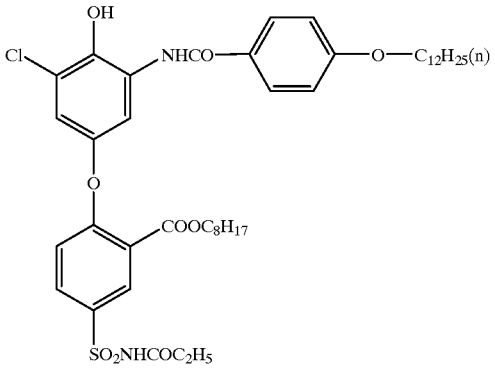
(C-28)
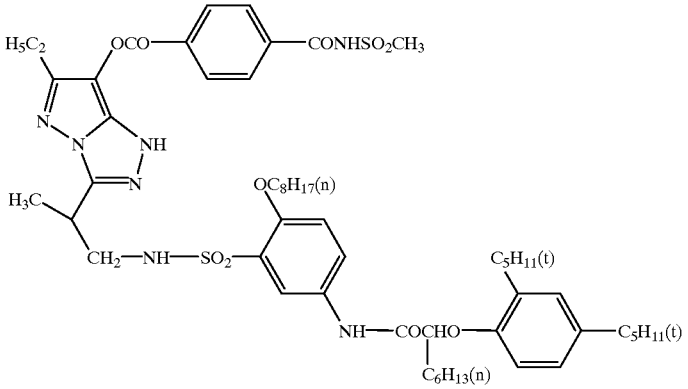
(C-29)
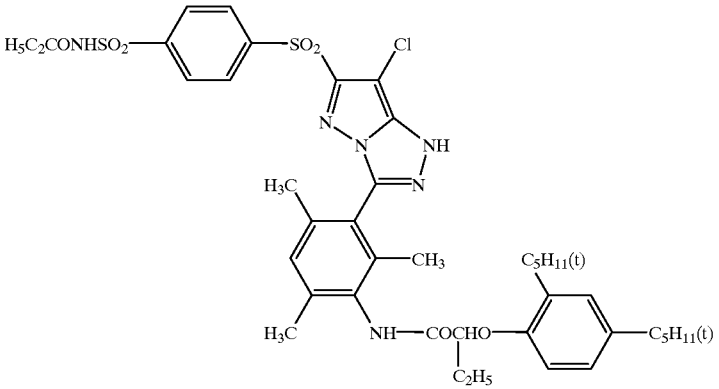

-continued
(C-30)
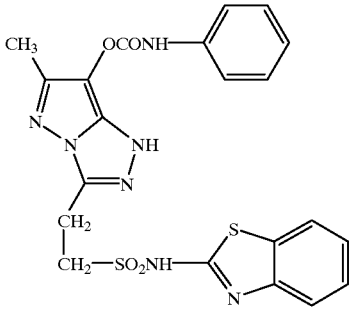
(C-31)
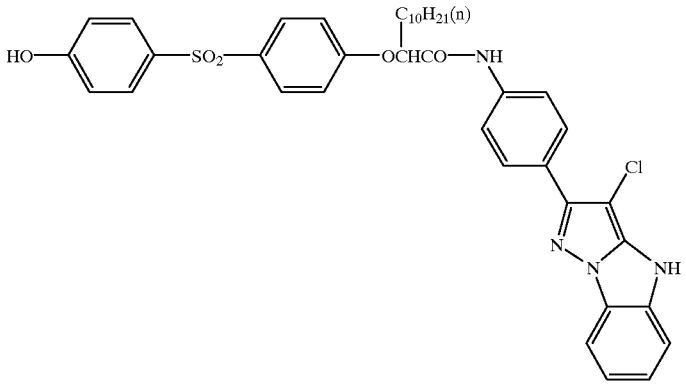
(C-32)
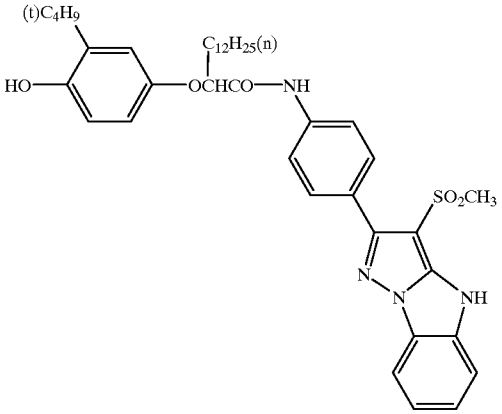
(C-33)
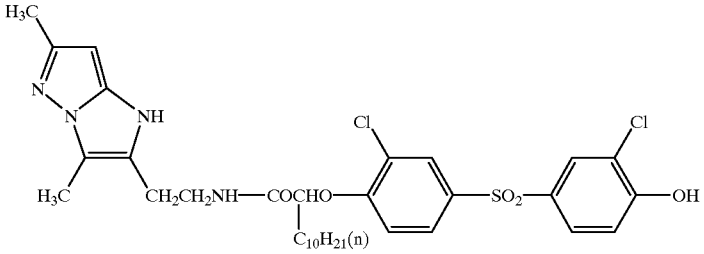

-continued
(C-34)
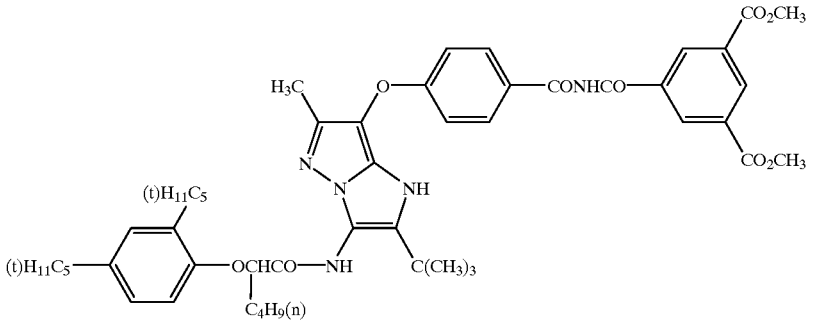
(C-35)
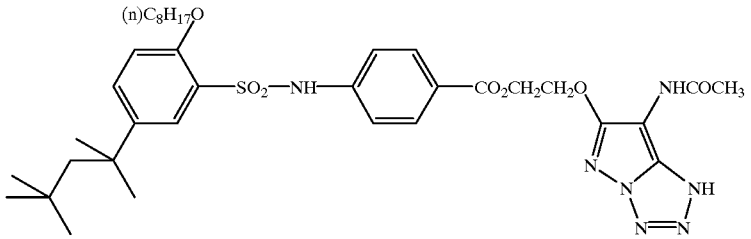
(C-36)
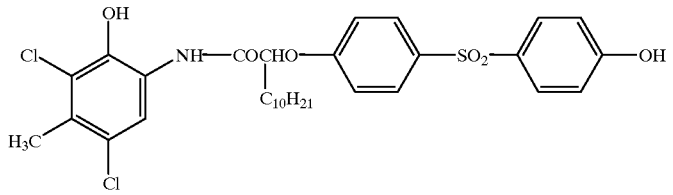
(C-37)
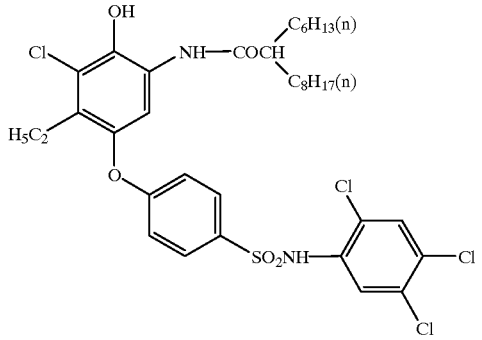
(C-38)
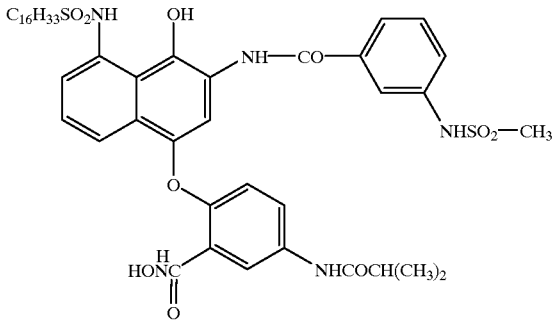

-continued
(C-39)
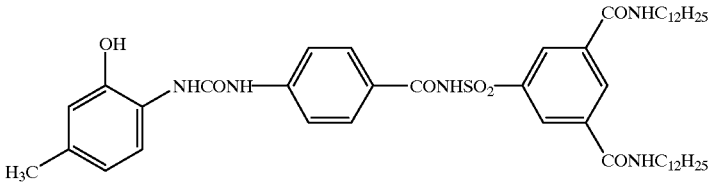
(C-40)
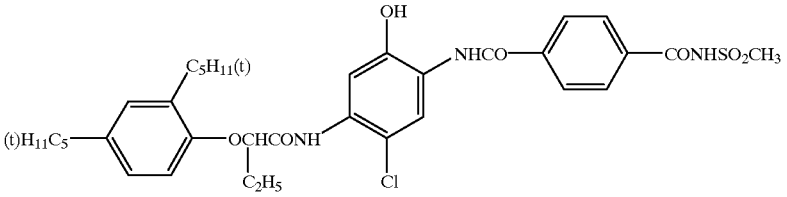
(C-41)
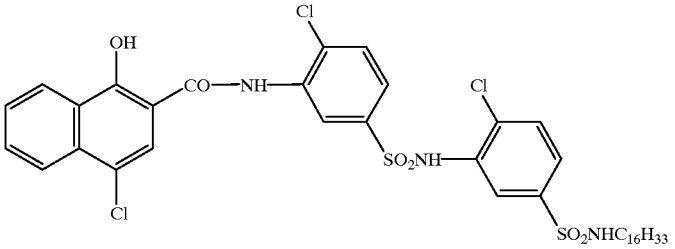
(C-42)
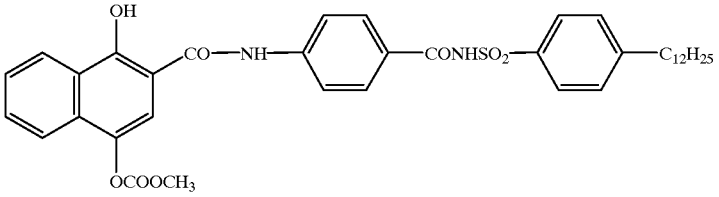
(C-43)
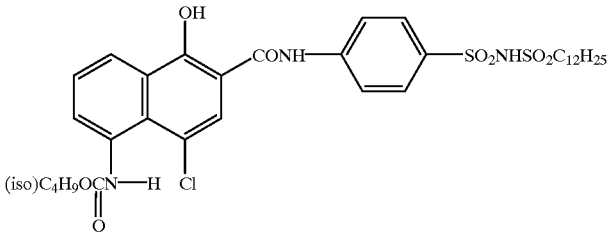
(C-44)
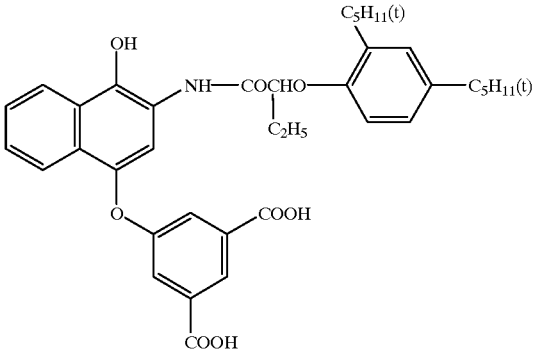

-continued
(C-45)
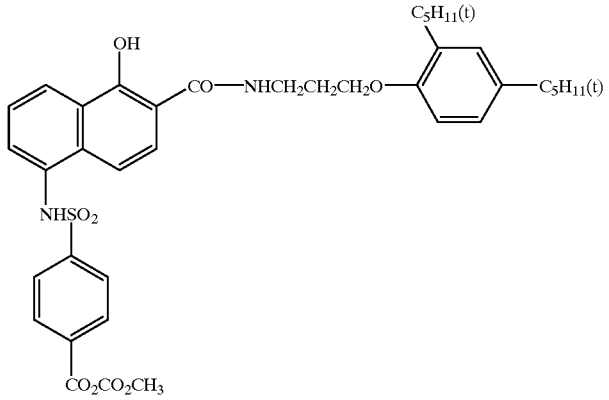
(C-46)
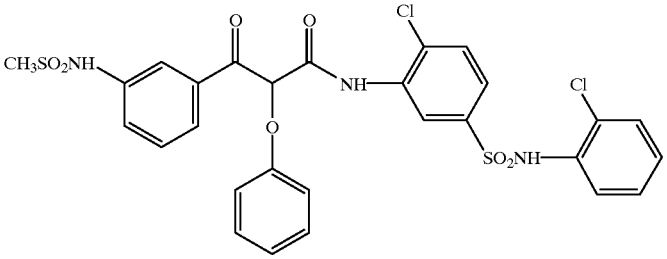
(C-47)
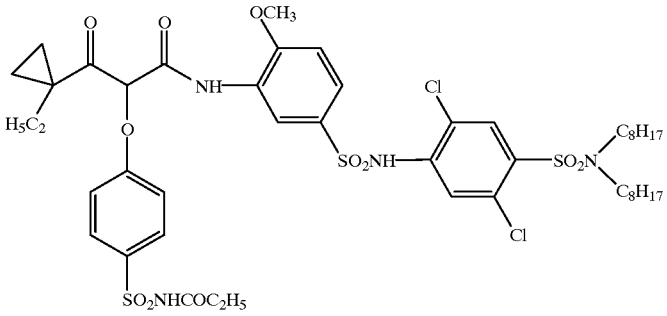
(C-48)
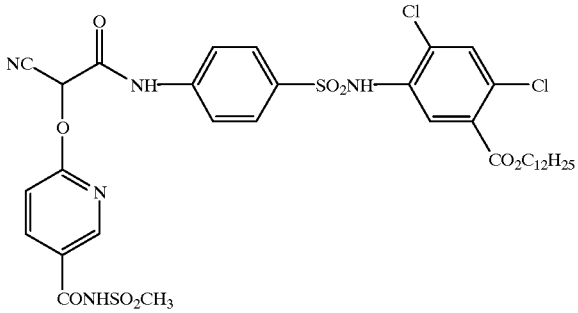

-continued
(C-49)
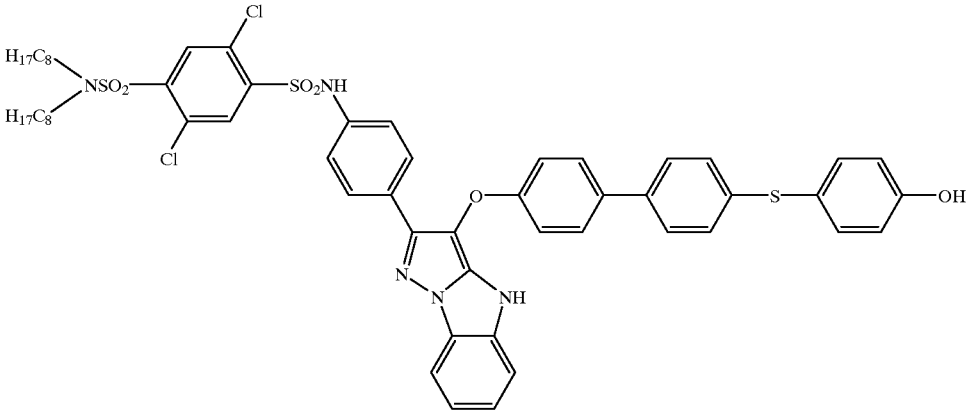
(C-50)
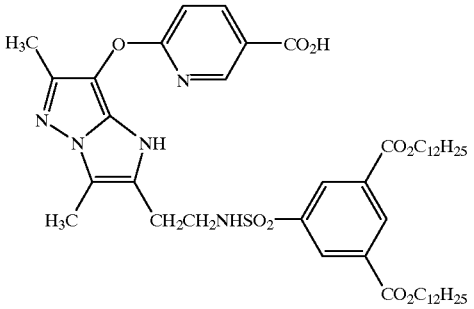
(C-51)
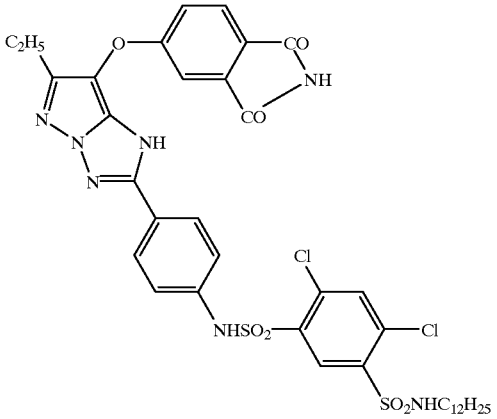
(C-52)
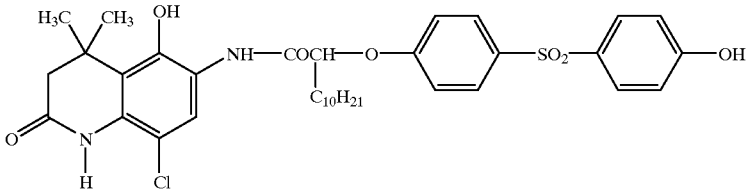

-continued
(C-53)
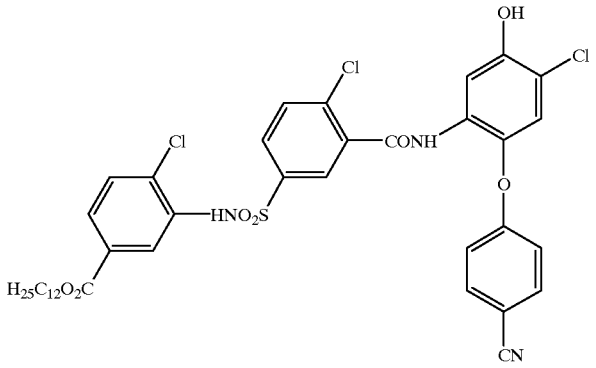
(C-54)
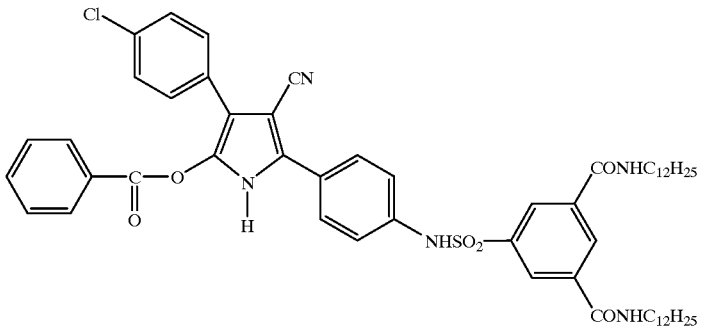
(C-55)
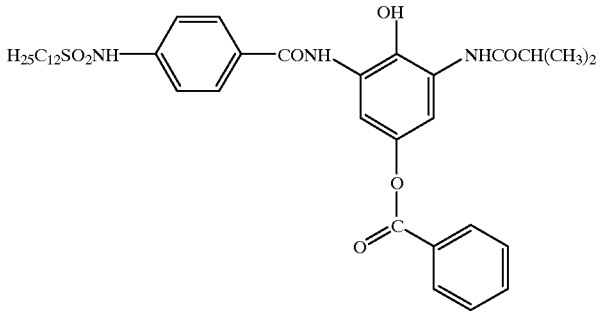
(C-56)
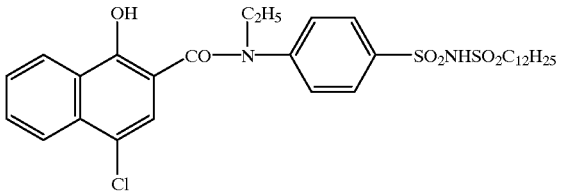
(C-57)
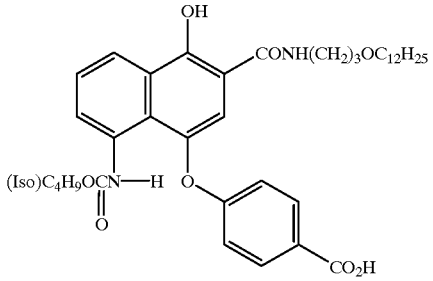

-continued (C-58)

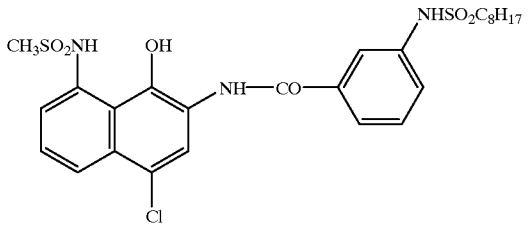

Representative synthetic example of the coupler represented by formula (II) for use in the present invention is shown below. Other compounds can be synthesized similarly to this example.

Synthetic Example

Synthesis of Exemplified Compound (C-52)

The synthesis was carried out according to the reaction scheme given below:

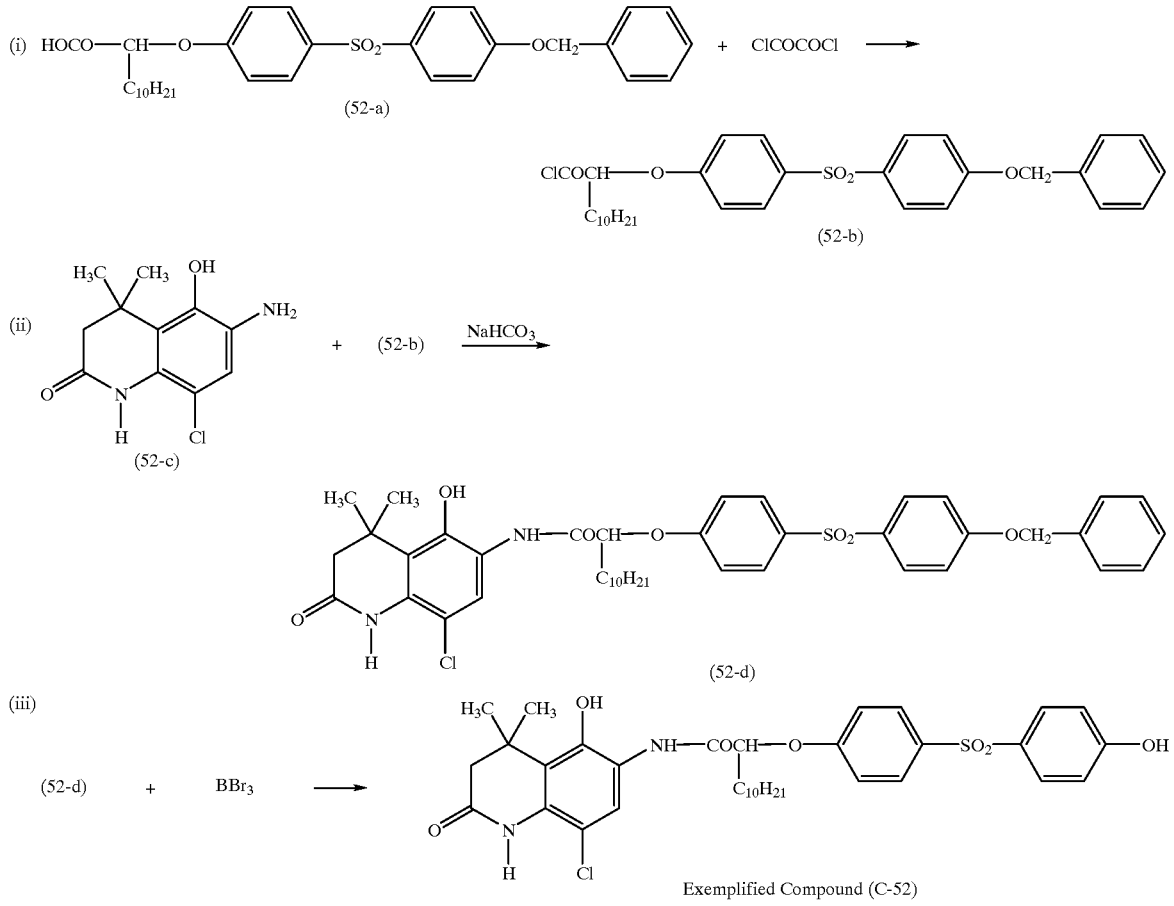

(1) Synthesis of Compound (52-d)

97.0 g (0.180 mol) of Compound (52-a) was dissolved in 400 ml of methylene chloride, and 0.3 ml of dimethylformamide was added thereto, and then 23.4 ml (0.27 mol) of oxalyl chloride was added, dropwise, thereto, over 10 min at room temperature. After the resultant mixture was reacted at room temperature for 1 hour, the solvent was distilled off under reduced pressure, to obtain Compound (52-b). This was dissolved in 100 ml of ethyl acetate, and the resulting solution was added, dropwise, to the mixed solution of 41.2 g (0.171 mol) of Compound (52-c), 600 ml of ethyl acetate, 36.1 g (0.430 mol) of sodium bicarbonate, and 600 ml of water, at room temperature over 30 min. After the resultant mixture was reacted for 2 hours at room temperature, the organic layer was separated, and the separated organic layer was washed with diluted hydrochloride acid and with saturated brine, and was dried over anhydrous magnesium sulfate. After filtering the dried organic layer, the solvent was distilled off under reduced pressure, and the residue was purified by silica gel column chromatography, using a mixed solvent of ethyl acetate/hexane (1:2) as an eluent, to obtain 93.8 g (0.123 mol) of a colorless amorphous of Compound (52-d). Yield: 72.0%.

(2) Synthesis of Compound (C-52)

67.2 g (0.0883 mol) of Compound (52-d) was dissolved in 1 liter of methylene chloride, and to the resultant solution was added, dropwise, 25 ml (0.265 mol) of $BBr_3$ dissolved in 50 ml of methylene chloride, with cooling with a dry ice-methanol refrigerant at a temperature of −20° C. to −10° C. for 30 min. After the resultant mixture was stirred at −10° C. to −5° C. for 1 hour, it was poured into 2 liters of ice water and stirred, and then the resultant organic layer was separated. The separated organic layer was washed with water for 3 times, and then it was dried over anhydrous magnesium sulfate. After the dried organic layer was filtered, the solvent was distilled off under reduced pressure. The residue was purified by silica gel column chromatography using a mixed solvent of ethyl acetate/hexane (1:1) as an eluent, to obtain 53.0 g (0.0789 mol) of a colorless amorphous of Exemplified Compound (C-52). Yield: 89.4%.

The coupler represented by formula (II) for use in the present invention is easily synthesized by various known methods.

Although the amount to be added, of the couplers that are used in the present invention, varies according to its molar extinction coefficient (ϵ), in order to obtain an image density of 1.0 or more in terms of reflection density, in the case of couplers wherein the ϵ of the dye that will be produced by coupling is of the order of 5,000 to 500,000, suitably the amount to be added, of the couplers that are used in the present invention, is of the order of generally 0.001 to 100 mmol/$m^2$, preferably 0.01 to 10 mmol/$m^2$, and more preferably 0.05 to 5 mmol/$m^2$, in terms of the coated amount.

The amount of the color-developing agent for use in the present invention to be added to the light-sensitive material is generally 0.01 to 100 times, preferably 0.1 to 10 times, and more preferably 0.2 to 5 times, the amount of the coupler.

In the present invention, an auxiliary developing agent can be preferably used. Herein the term "an auxiliary developing agent" means a substance that functions to promote the transfer of electrons from the color-developing agent to silver halides in the development process of the silver halide development; and in the present invention, preferably the auxiliary developing agent is a compound capable of releasing electrons according to the Kendall-Pelz rule, which compound is represented preferably by formula (D-1) or (D-2). Among these, compounds represented by (D-1) is particularly preferable.

formula (D-1)

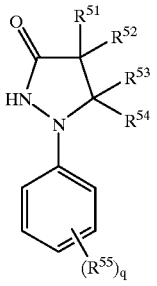

-continued formula (D-2)

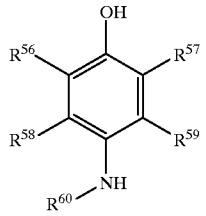

In formulae (D-1) and (D-2), $R^{51}$ to $R^{54}$ each represent a hydrogen atom, an alkyl group, a cycloalkyl group, an alkenyl group, an aryl group, or a heterocyclic group.

$R^{55}$ to $R^{59}$ each represent a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclicamino group, an alkylthio group, an arylthio group, a heterocyclicthio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, an arenesulfinyl group, an alkanesulfonyl group, an arenesulfonyl group, a sulfamoyl group, a sulfo group, a phosphinoyl group, or a phosphinoylamino group.

q is an integer of 0 to 5, and when q is 2 or more, $R^{55}$'s may be different. $R^{60}$ represents an alkyl group or an aryl group.

Compounds represented by formula (D-1) or (D-2) are shown specifically below, but the auxiliary developing agent used in the present invention is not limited to these specific examples.

(ETA-1)

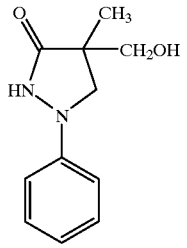

(ETA-2)

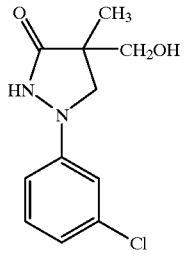

-continued
(ETA-3)
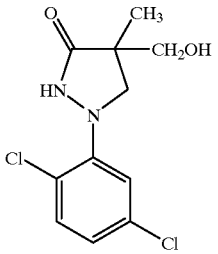
(ETA-4)
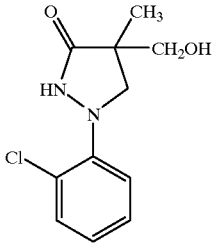
(ETA-5)
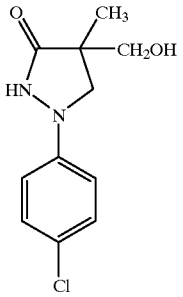
(ETA-6)
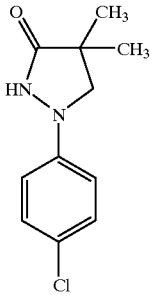
-continued
(ETA-7)
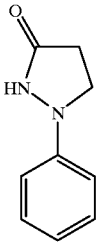
(ETA-8)
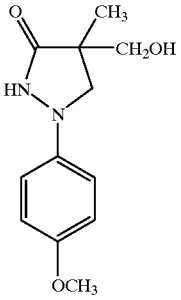
(ETA-9)
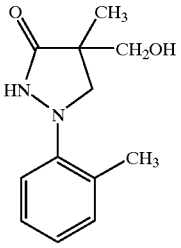
(ETA-10)
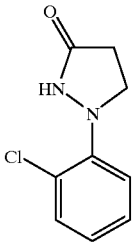
(ETA-11)
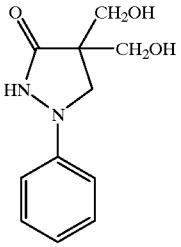

-continued
(ETA-12)
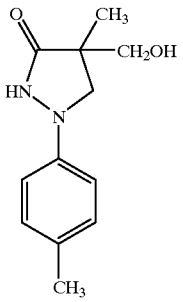
(ETA-13)
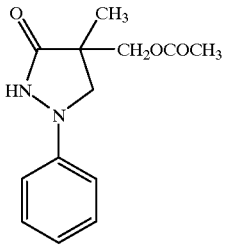
(ETA-14)
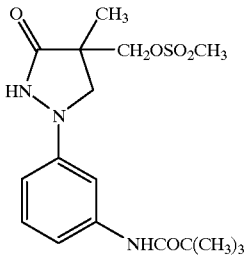
(ETA-15)
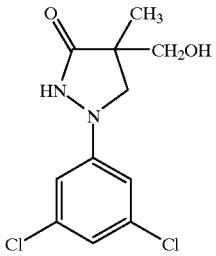
(ETA-16)
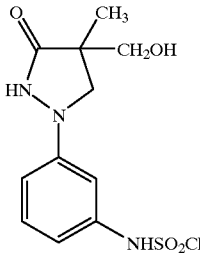
-continued
(ETA-17)
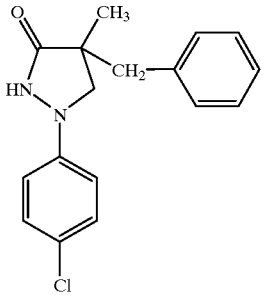
(ETA-18)
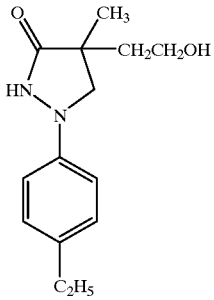
(ETA-19)
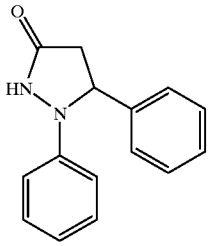
(ETA-20)
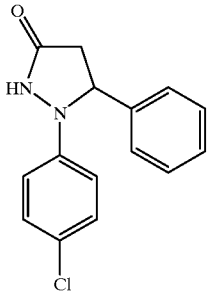
(ETA-21)
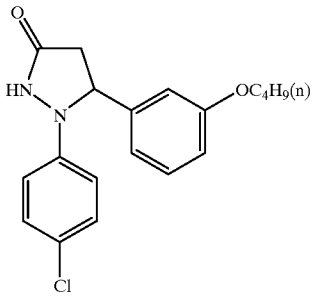

-continued
(ETA-22)
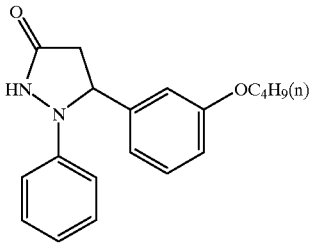
(ETA-23)
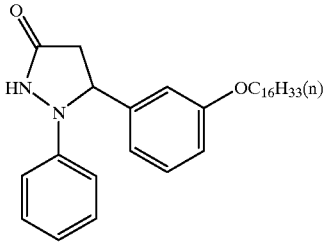
(ETA-24)
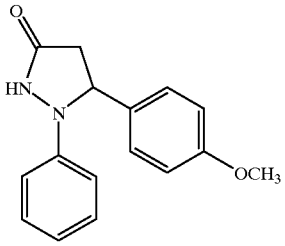
(ETA-25)
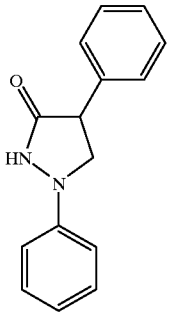
-continued
(ETA-26)
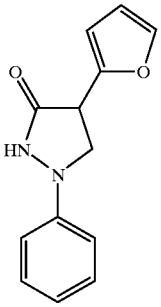
(ETA-27)
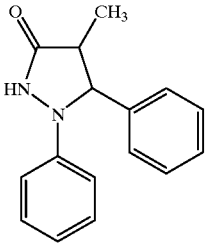
(ETA-28)
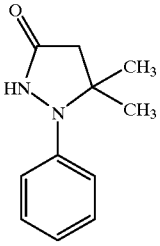
(ETA-29)
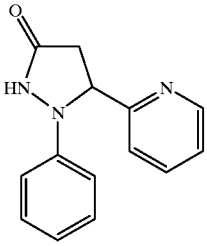
(ETA-30)
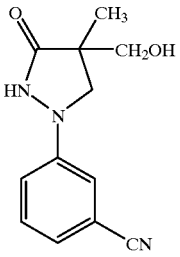

-continued (ETA-31)

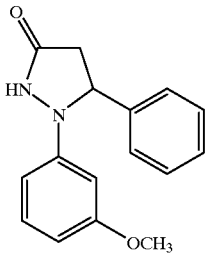

(ETA-32)

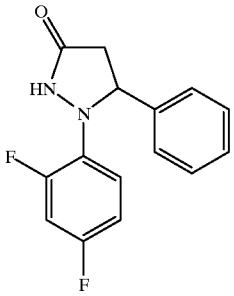

(ETA-33)

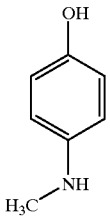

(ETA-34)

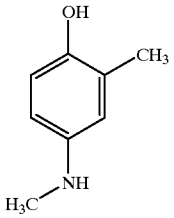

(ETA-35)

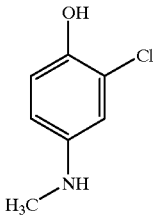

(ETA-36)

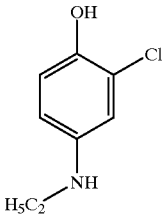

In the present invention, a blocked photographic reagent, represented by formula (A), that will release a photographically useful group at the time of processing, can be used:

$$A\text{-}(L)_1\text{-}PUG \qquad \text{formula (A)}$$

A represents a blocking group whose bond to $(L)_1$-PUG will be split off at the time of development processing; L represents a linking group whose right bond (in the above formula (A)) will be split off after the bond on the left of L is split off; 1 is an integer of 0 to 3; and PUG represents a photographically useful group.

Groups represented by formula (A) will now be described.

As the blocking group represented by A, the following already known groups can be used: blocking groups described, for example, in JP-B-48-9968, JP-A-52-8828 and 57-82834, U.S. Pat. No. 3,311,476, and JP-B-47-44805 (U.S. Pat. No. 3,615,617), such as an acyl group and a sulfonyl group; blocking groups that use the reverse Michael reaction, as described, for example, in JP-B-55-17369 (U.S. Pat. No. 3,888,677), 55-9696 (U.S. Pat. No. 3,791,830), and 55-34927 (U.S. Pat. No. 4,009,029), and JP-A-56-77842 (U.S. Pat. No. 4,307,175), 59-105640, 59-105641, and 59-105642; blocking groups that use the formation of quinone methide, or a compound similar to quinone methide, by intramolecular electron transfer, as described, for example, in JP-B-54-39727, U.S. Pat. Nos. 3,674,478, 3,932,480, and 3,993,661, and JP-A-57-135944, 57-135945 (U.S. Pat. No. 4,420,554), 57-136640, 61-196239, 61-196240 (U.S. Pat. No. 4,702,999), 61-185743, 61-124941 (U.S. Pat. No. 4,639,408), and 2-280140; blocking groups that use intramolecular nucleophilic substitution reaction, as described, for example, in U.S. Pat. Nos. 4,358,525 and 4,330,617, and JP-A-55-53330 (U.S. Pat. No. 4,310,612), 59-121328, 59-218439, and 63-318555 (EP-A-0295729); blocking groups that use ring cleavage of a 5-membered ring or 6-membered ring, as described, for example, in JP-A-57-76541 (U.S. Pat. No. 4,335,200), 57-135949 (U.S. Pat. No. 4,350,752), 57-179842, 59-137945, 59-140445, 59-219741, 59-202459, 60-41034 (U.S. Pat. No. 4,618,563), 62-59945 (U.S. Pat. No. 4,888,268), 62-65039 (U.S. Pat. No. 4,772,537), 62-80647, 3-236047, and 3-238445; blocking groups that use the addition reaction of a nucleophilic reagent to a conjugated unsaturated bond, as described, for example, in JP-A-59-201057 (U.S. Pat. No. 4,518,685), 61-95346 (U.S. Pat. No. 4,690,885), 61-95347 (U.S. Pat. No. 4,892,811), 64-7035, 64-42650 (U.S. Pat. No. 5,066,573), 1-245255, 2-207249, 2-235055 (U.S. Pat. No. 5,118,596), and 4-186344; blocking groups that use the A-elimination reaction, as described, for example, in JP-A-59-93442, 61-32839, and 62-163051, and JP-B-5-37299; blocking groups that use the nucleophilic substitution reaction of diarylmethanes, as described in JP-A-61-188540; blocking groups that uses the Lossen rearrangement reaction, as described in JP-A-62-187850; blocking groups that use the reaction between the N-acylated product of thiazolidin-2-thion and amines, as described in JP-A-62-80646, 62-144163, and 62-147457; and blocking groups that have two electrophilic groups to react with two nucleophilic agents, as described in JP-A-2-296240 (U.S. Pat. No. 5,019,492), 4-177243, 4-177244, 4-177245, 4-177246, 4-177247, 4-177248, 4-177249, 4-179948, 4-184337, and 4-184338, WO-A-92/21064, JP-A-4-330438, WP-A-93/03419, and JP-A-5-45816, as well as JP-A-3-236047 and 3-238445.

The group represented by L in the compound represented by formula (A) may be any linking group that can be split off from the group represented by A, at the time of development processing, and that then can split $(L)_1$-PUG. Examples include groups that use the cleavage of a hemiacetal ring, as described in U.S. Pat. Nos. 4,146,396, 4,652,516, and 4,698,297; timing groups that bring about an intramolecular nucleophilic substitution reaction, as described in U.S. Pat. Nos. 4,248,962, 4,847,185, or 4,857,440; timing groups that use an electron transfer reaction to bring about a cleavage reaction, as described in U.S. Pat. No. 4,409,323 or 4,421,845; groups that use the hydrolysis reaction of an iminoketal to bring about a cleavage reaction, as described in U.S. Pat. No. 4,546,073; groups that use the hydrolysis reaction of an ester to bring about a cleavage reaction, as described in West German Publication Patent No. 2 626 317; or groups that use a reaction with sulfite ions to bring about a cleavage reaction, as described in EP-0 572 084.

PUG in formula (A) will now be described.

PUG in formula (A) represents a group photographically useful for an antifoggant, a photographic dye, and the like, and in the present invention the auxiliary developing agents represented by formula (D-1) or (D-2) are particularly preferably used for PUG.

When the auxiliary developing agents represented by formula (D-1) or (D-2) correspond to PUG of formula (A), the bonding position is at the oxygen atom or nitrogen atom of the auxiliary developing agent.

The photographic light-sensitive material of the present invention, basically, has on a base, a photosensitive silver halide, a color-developing agent, a coupler, a binder, and, if required, an organic metal salt oxidant, and the like. In many cases, these components are added to the same layer of the photographic constitutional layers provided on a base (in, for example, a light-sensitive layer), but they can be separately added to different layers of the photographic constitutional layers if the components are in reactive states.

Hydrophobic additives used in the present invention, such as couplers and color-developing agents, can be introduced into photographic constitutional layers (such as hydrophilic colloid layers, e.g. silver halide emulsion layers) of a photographic material by a known method, such as the one described in U.S. Pat. No. 2,322,027. In this case, use can be made of a high-boiling organic solvent as described, for example, in U.S. Pat. Nos. 4,555,470, 4,536,466, 4,536,467, 4,587,206, 4,555,476, and 4,599,296, and JP-B-3-62256, if necessary, in combination with a low-boiling organic solvent having a boiling point of 50 to 160° C. These couplers, color-developing agents (nondiffusion reducing agents), high-boiling organic solvents, and the like can be used in the form of a combination of two or more.

The high-boiling organic solvent is used in an amount of generally more than 0 g but 10 g or less, preferably 5 g or less, and more preferably 1 g to 0.1 g, per g of the compound for forming a color image. The amount is also suitably generally 1 cc or less, particularly 0.5 cc or less, and more particularly more than 0 cc but 0.3 cc or less, per g of the binder.

A dispersion method that use a polymer, as described in JP-B-51-39853 and JP-A-51-59943, and a method wherein the addition is made with them in the form of a dispersion of fine particles, as described, for example, in JP-A-62-30242 and 63-271339, can also be used. If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used. Examples of the surface-active agents that can be used are listed in JP-A-59-157636, pages 37 to 38, and in the RD publication shown in a table below.

In the photographic material of the present invention, use can be made of a compound that can activate the development and make the image stable. Preferable specific compounds for use are described in U.S. Pat. No. 4,500,626, the 51st column to the 52nd column.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive layer, can be mentioned. The photosensitive layers can be arranged in various orders known generally for color photographic materials. Further, each of these photosensitive layers can be divided into two or more layers if necessary.

In the photographic material, various auxiliary layers can be provided, such as a protective layer, an underlayer, an intermediate layer, an antihalation layer, and a backing layer. Further, in order to improve the color separation, various filter dyes can be added.

The silver halide emulsion that can be used in the present invention may be made of any of silver chloride, silver bromide, silver iodobromide, silver chlorobromide, silver chloroiodide, and silver chloroiodo-bromide. The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or 4-223643. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these. Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23; RD No. 18,716 (November 1979), page 648; RD No. 307,105 (November 1989), pages 863 to 865; JP-A-62-253159, 64-13546, 2-236546, and 3-110555; by P. Glafkides in *Chemie et Phisigue Photographique*, Paul Montel (1967); by G. F. Duffin in *Photographic Emulsion Chemistry*, Focal Press, 1966; and by V. L. Zelikman et al., in *Making and Coating Photographic Emulsion*, Focal Press, 1964.

When the tabular grains are used, such merits are obtained that the covering power is increased and the color sensitization efficiency due to a sensitizing dye is increased, as described in detail in U.S. Pat. No. 4,434,226. The average aspect ratio of 80% or more of all the projected areas of grains is desirably generally 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,798,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A-63-163451, are also preferable.

In the case of tabular grains, it is possible to observe dislocation lines under a transmission-type electron microscope. In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, and dislocation introduced limitedly in a particular part of grains, such as fringes. In addition to the case of introduction of dislocation lines into tabular grains, also preferable is the case of introduction of dislocation lines into regular crystalline grains or irregular grains, represented by potato grains. In this case, a preferable mode is that introduction is limited to a particular part of grains, such as vertexes and edges.

The light-sensitive silver halide emulsion that is used in the present invention may contain a heavy metal, such as iridium, rhodium, platinum, cadmium, zinc, thallium, lead, iron, osmium, and chromium, for various purposes. The compounds of the heavy metal may be used singly or in the form of a combination of two or more. Further, these compounds may be added in the form of a salt, such as a chloride, a bromide, and a cyanide, as well as in the form of various complex salts. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, 1-116637, and 5-181246 are preferably used.

Further, to quicken the growth of the crystals, the concentrations, the amounts, and the speeds of the silver salt and the halide to be added may be increased (e.g. JP-A-55-142329 and 55-158124, and U.S. Pat. No. 3,650,757). As the method of stirring the reaction liquid, any of known stirring methods may be used. The temperature and the pH of the reaction liquid during the formation of the silver halide grains may be set arbitrarily to meet the purpose. Preferably the pH range is 2.2 to 8.5, and more preferably 2.5 to 7.5.

In the case of a heat-development light-sensitive material, the light-sensitive silver halide emulsion may be used together with an organosilver salt oxidizing agent. As the organic compounds that can be used to form it, benzotriazoles, aliphatic acids, and other compounds, as described in U.S. Pat. No. 4,500,626, columns 52 to 53, can be mentioned. Acetylene silver, described in U.S. Pat. No. 4,775,613, is also useful. Organosiliver salts may be used in the form of a combination of two or more.

The above organosilver salts may be used additionally in an amount of generally 0.01 to 10 mol, and. preferably 0.01 to 1 mol, per mol of the light-sensitive silver halide. Suitably the total coating amount of the light-sensitive silver halide emulsion plus the organosilver salt is generally 0.05 to 10 $g/m^2$, and preferably 0.1 to 4 $g/m^2$, in terms of silver.

The light-sensitive silver halide emulsion is generally a chemically sensitized silver halide emulsion. To chemically sensitize the light-sensitive silver halide emulsion for use in the present invention, for example, a known chalcogen sensitization method, such as the sulfur sensitization method, the selenium sensitization method, and the tellurium sensitization method; the noble metal sensitization method, wherein gold, platinum, or palladium is used; and the reduction sensitization method, can be used alone or in combination (e.g. JP-A-3-110555 and 5-241267).

As the tellurium sensitizer, compounds described in CA-800 958, GB-1 295 462 and 1 396 696, and Japanese patent application Nos. 2-333819 and 3-131598 can be used, and specific tellurium sensitizers include colloidal tellurium, telluroureas (e.g. tetramethyltellurourea, N-carboxyethyl-N', N'-dimethyltellurourea, and N,N'-dimethylethylenetelluorourea), isotellurocyanates, telluroketones, telluroamides, tellurohydrazides, telluroesters, phosphine tellurides (e.g. tributylphosphine telluride and butyldiisopropylphosphine telluride), and other tellurium compounds (e.g. potassium tellurocyanate and sodium telluropentathionate).

The amount to be added of the tellurium sensitizer is generally on the order of $10^{-7}$ to $5\times10^{-2}$ mol, and preferably $5\times10^{-7}$ to $10^{-3}$ mol, per mol of the silver halide.

Further, during the process of the production of the silver halide emulsion, an oxidizing agent for silver is preferably used.

Preferable oxidizing agents are ozone, hydrogen peroxide and its adducts, halogen elements, inorganic oxidizing agents of thiosulfonates, and organic oxidizing agents of quinones. The use of a combination of the above reduction sensitization with the oxidizing agent for silver is a preferable mode. After the use of the oxidizing agent, reduction sensitization may be carried out, or the order may be reversed, or a method wherein both are present simultaneously can be chosen to use. These methods can be selectively used in the step of forming grains or in the chemical sensitizing step. These chemical sensitizations can be carried out in the presence of a nitrogen-containing heterocyclic compound (JP-A-62-253159). Further, the below-mentioned antifoggant-can be added after the completion of the chemical sensitization. Specifically, methods described in JP-A-5-45833 and 62-40446 can be used. At the time of the chemical sensitization, the pH is preferably 5.3 to 10.5, and more preferably 5.5 to 8.5, and the pAg is preferably 6.0 to 10.5, and more preferably 6.8 to 9.0. The coating amount of the light-sensitive silver halide emulsion used in the present invention is generally in the range of 1 mg to 10 $g/m^2$ in terms of silver.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region. Dyes that can be used include cyanine dyes, merocyanine dyes, composite cyanin dyes, composite merocyanine dyes, halopolar cyanine dyes, hemicyanine dyes, styryl dyes, and hemioxonol dyes. Specifically, sensitizing dyes described, for example, in U.S. Pat. No. 4,617,257 and JP-A-59-

180550, 64-13546, 5-45828, and 5-45834 can be mentioned. These sensitizing dyes can be used singly or in combination, and a combination of these sensitizing dyes is often used, particularly for the purpose of adjusting the wavelength of the spectral sensitivity, and for the purpose of supersensitization. Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145). The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. Nos. 4,183,756 and 4,225,666. Further, these sensitizing dyes and supersensitizers may be added in the form of a solution of an organic solvent, such as methanol, or in the form of a dispersion of gelatin, or in the form of a solution of a surface-active agent. Generally the amount of the sensitizing dye to be added is of the order of $10^{-5}$ to $10^{-2}$ mol per mol of the silver halide.

These additives used in the above process, and conventionally known additives for photography that can be used in light-sensitive materials and dye-fixing materials, are described in Research Disclosure No. 17643; Research Disclosure No. 18176; and Research Disclosure No. 307105, whose particular parts are given below in a table.

| Additive | RD 17643 | | RD 18716 | RD 307105 |
|---|---|---|---|---|
| 1 Chemical sensitizers | p.23 | p.648 | (right column) | p.866 |
| 2 Sensitivity-enhancing agents | — | p.648 | (right column) | — |
| 3 Spectral sensitizers and Supersensitizers | pp.23–24 | pp.648–649 | (right column) (right column) | pp.866–868 |
| 4 Brightening agents | p.24 | p.648 | (right column) | p.868 |
| 5 Antifoggingagents and Stabilizers | pp.24–25 | p.649 | (right column) | pp.868–870 |
| 6 Light absorbers, Filter dyes, and UV Absorbers | pp.25–26 | pp.649–650 | (right column) (left column) | p.873 |
| 7 Stain-preventing agents | p.25 (right column) | p.650 | (left to right column) | p.872 |
| 8 Image dye stabilizers | p.25 | p.650 | (left column) | p.872 |
| 9 Hardeners | p.26 | p.651 | (left column) | pp.874–875 |
| 10 Binders | p.26 | p.651 | (left column) | pp.873–874 |
| 11 Plasticizers and Lubricants | p.27 | p.650 | (right column) | p.876 |
| 12 Coating aids and Surface-active agents | pp.26–27 | p.650 | (right column) | pp.875–876 |
| 13 Antistatic agents | p.27 | p.650 | (right column) | pp.876–877 |
| 14 Matting agents | — | | — | pp. 878–879 |

As the binder of the constitutional layers of the light-sensitive material, one that is hydrophilic is preferably used. Examples thereof include those described in the above-mentioned Research Disclosures and JP-A-64-13546, pages 71 to 75. Specifically, transparent or semitransparent hydrophilic binders are preferable, such as gelatin and gelatin derivatives. As the gelatin, lime-processed gelatin, acid-processed gelatin, or so-called delimed gelatin, wherein the contents of calcium and the like are reduced, may be selected to meet the purpose, and a combination of these gelatins is also preferably used.

Other techniques and inorganic or organic materials that can also be used for color photographic light-sensitive materials of the present invention are described in the below-shown sections in EP-A-436 938 (A2) and the below-shown patents cited therein.

| | |
|---|---|
| 1) Layer configuration | page 146, line 34 to page 147, line 25 |
| 2) Antiseptics and mildewproofing agents | page 150, lines 25 to 28 |
| 3) Formalin scavengers | page 149, lines 15 to 17 |
| 4) Other additives | page 153, lines 38 to 47; and EP-A-421 453 (A1), page 75, line 21 to page 64, line 56, and page 27, line 40 to page 37, 1ine 40 |
| 5) Dispersion methods | page 150, 1ines 4 to 24 |
| 6) Supports (bases) | page 150, 1ines 32 to 34 |
| 7) Film thickness and film physical properties | page 150, lines 35 to 49 |
| 8) Desilvering step | page 15, line 48 to page 152, line 53 |
| 9) Automatic processors | page 152, line 54 to page 153, line 2 |
| 10) Washing/stabilizing steps | page 153, lines 3 to 37 |

Example methods of exposing the photographic material to light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, 5-176144, 5-199372, 6-127021); and a method wherein image information is outputted to an image display apparatus, such as a CRT, a liquid crystal display, an electroluminescence display, and a plasma display, and exposure is carried out directly or through an optical system.

Light sources that can be used for recording an image on the photographic material, as mentioned above, include natural light and light sources and exposure methods described in U.S. Pat. No. 4,500,626, 56th column, and JP-A-2-53378 and 2-54672, such as a tungsten lamp, a light-emitting diode, a laser light source, and a CRT light source. Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and 62-210432 can be preferably used. As the form of the wavelength-converting element, for example, a single crystal optical waveguide type and a fiber type are known, both of which are useful. The above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

As a method of development-processing the light-sensitive material of the present invention, in which the color-developing agent for use in the present invention is built in, after exposure to light, an activator process, wherein the light-sensitive material is subjected to development with an alkaline processing solution that does not contain a color-developing agent; a method wherein development is carried out using a processing solution containing an auxiliary development agent/base; a method in which the said alkaline processing solution in the diffusion transfer system is developed (applied) on the light-sensitive material; and a method in which development is carried out by heat development, may be used.

The term "activator process" means a process wherein a color-forming reducing agent (a color-developing agent) is built in a light-sensitive material and the light-sensitive material is subjected to a development process with a processing solution free from any color-developing agent. In the present invention, "the activator solution" is characterized by substantially not containing any p-phenylenediamine-series color-developing agent that is conventionally used, and it may contain other components (e.g. alkalis, halogens, and chelating agents). In some cases, preferably the activator solution does not contain any reducing agent, in order to keep the processing stability, and in that case the activator solution preferably does not substantially contain any auxiliary developing agents, hydroxyamines, sulfites, and the like.

Herein, the term "does not substantially contain" means that preferably the content is 0.5 mmol/liter or less, more preferably 0.1 mmol/liter or less, and particularly preferably not containing at all. The pH of the alkaline processing solution is preferably 9 to 14, and particularly preferably 10 to 13.

Light-sensitive materials that are used in activator process and the processings thereof are described, for example, in Japanese patent application Nos. 7-63572, 7-334190, 7-334192, 7-334197, and 7-344396.

Further, in the present invention, when a light-sensitive material is subjected to development with a developing solution, a compound that functions as a developing agent of the silver halide and/or that works to allow the oxidization product of the developing agent resulting from silver development to cross-oxidize the reducing agent (color-developing agent) for color formation built in the light-sensitive material, can be used in the developing solution. Preferably, pyrazolidones, dihydroxybenzenes, reductones, and aminophenols are used, and particularly preferably pyrazolidones are used. In addition, with respect to additives, processing procedures (methods), processing conditions, etc., used in the development processing, the bleaching, the fixing, and the washing (stabilization), those described in JP-A-8-101484, page 13, column 24, line 33, to page 19, column 35, line 28, are preferably applied. If the amount of the silver halide to be used is small, the desilvering process can be omitted.

The actual processing time by a developing apparatus (processors using processing solutions is generally determined based on the linear velocity and the volume of the processing bath, and it is suggested that in the present invention the linear velocity is, for example, 500 to 4,000 mm/min. Particularly in the case of a small-sized developing apparatus, the linear velocity is preferably 500 to 2,500 mm/min.

The processing time of all the processing steps; that is, the processing time from the developing step to the drying step, is preferably 360 sec or less, more preferably 120 sec or less, and particularly preferably 90 to 30 sec. Herein, the term "processing time" means the time from the dipping of the light-sensitive material in the developing solution to the emergence of the light-sensitive material from the drying part of the processor.

The term "development (applied) process of an alkaline processing solution in the diffusion transfer system", means a process which is known in the art as an instant processing system, in which process an alkaline processing solution is developed (applied) to form a liquid film that is generally about 500 $\mu$m or less, and preferably 50 to 200 $\mu$m, in thickness onto a light-sensitive material having, on the same support or separate supports, a light-sensitive element comprising at least one light-sensitive layer/dye-forming layer (preferably the light-sensitive layer and the dye-forming layer constituting the same layer) and an image-receiving element having a mordant layer for capturing/mordanting the diffusion dye produced from the light-sensitive layer/dye-forming layer, to process the light-sensitive material.

When an auxiliary developing agent is built in, preferably the alkaline processing solution does not contain any auxiliary developing agent, in view of the production and the preservation of the processing solution.

In the case of the diffusion transfer system, the pH of the alkaline processing solution is preferably 10 to 14, and particularly preferably 12 to 14.

The process for instant light-sensitive materials is described by T. H. James in *The Theory of Photographic Process,"* 4th edition (1977, Macmillan), and the constitution of specific film units is described in JP-A-63-226649. Examples of materials contained in the film units and various layers containing the materials are described below.

Dye-image-receiving layers and mordants contained therein are described in JP-A-61-252551 and U.S. Pat. Nos. 2,548,564, 3,756,814, 4,124,386, and 3,652,694. Neutralizing layers used for lowering the pH of the light-sensitive material after the development (application) of the alkaline processing solution are described in JP-B-7-122753, U.S. Pat. No. 4,139,383, and RD No. 16102, and timing layers that are used in combination with the neutralizing layers are described in JP-A-54-136328 and U.S. Pat. Nos. 4,267,262, 4,009,030, and 4,268,604. As the silver halide emulsion, any emulsion can be used, and as preferable autopositive emulsions for light-sensitive materials for photographing, those described in JP-A-7-333770 and 7-333771 can be mentioned.

In addition, if required, light-shielding layers, reflective layers, intermediate layers, separating layers, ultraviolet-absorbing layers, filter layers, overcoat layers, adhesion-improving layers, and the like can be provided.

The processing solution for processing the above light-sensitive materials contains processing components required for the development, and generally a thickening agent is incorporated in the processing components, to cause them to be developed (applied) uniformly on the light-sensitive material. As the thickening agent, a thixotropic one, such as carboxymethylcellulose and hydroxyethylcellulose, is preferable.

Details of the light-sensitive layer and the processing solution are described in JP-A-7-333771.

The heating treatment in heat development of photographic materials is known in the art, and it may be applied for the light-sensitive material of the present invention. The heat-development photographic materials and the process thereof are described, for example, in "Shashin Kogaku no Kiso" (published by Corona-sha, 1979), pages 553 to 555; "Eizo Joho" (published April 1978), page 40; "Nebletts Handbook of Photography and Reprography," 7th edition (Van Nostrand and Reinhold Company), pages 32 to 33; U.S. Pat. Nos. 3,152,904, 3,301,678, 3,392,020, and 3,457,075, GB-1 131 108 and 1 167 777, and Research Disclosure (June 1978), pages 9 to 15 (RD-17029).

For the purpose of accelerating the silver development and the dye-forming reaction, to the light-sensitive material of the present invention are preferably applied basic precursors described, for example, in U.S. Pat. Nos. 4,514,493 and 4,657,848, and in *Known Technique* (Kochi Gijutsu), No. 5 (March 22, 1991, published by Azutech Yugen-kaisha), pages 55 to 86; and base-generating methods described in EP-A-210 660 and U.S. Pat. No. 4,740,445.

For the purpose of accelerating the heat development, to the light-sensitive material of the present invention may be added heat solvents described in U.S. Pat. No. 3,347,675 and 3,667,959.

When the light-sensitive material of the present invention is processed by heating, in order to accelerate the development and/or to perform the diffusion transfer of the material for the processing, also preferably the light-sensitive material or the processing sheet is impregnated with water, an aqueous solution containing an inorganic alkali metal salt or an organic base, a low-boiling solvent, or a mixed solvent of a low-boiling solvent with water, or with the aqueous basic solution containing an inorganic alkali metal salt or an organic base, and the light-sensitive material or the processing sheet is processed by heating. The method wherein water is used is described, for example, in JP-A-63-144354, 63-144355, 62-38460, 3-210555, 62-253159, and 63-85544, EP-A-210 660, and U.S. Pat. No. 4,740,445.

The present invention can also be applied to heat development image-forming methods and heat development light-sensitive materials, as described, for example, in JP-A-7-261336, 7-268045, 8-30103, 8-46822, and 8-97344.

The heating temperature in the heat development step is generally about 50 to 200° C., and particularly usefully the heating temperature in the heat development step is preferably 60 to 180° C., more preferably 65 to 180° C., and particularly preferably 65° C. to 150° C. If any solvent is used, preferably the heat development is carried out at a temperature below the solvent's boiling point.

According to the use of the color-developing agents and couplers for use in the present invention, could have remarkably improved color-forming property, and processing temperature dependence, particularly developing temperature dependence as well.

The present invention will now be described specifically with reference to the examples, but of course the present invention is not limited to them.

EXAMPLES

Example 1

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to produce a multi-layer color printing paper (101) having the layer configuration shown below. The coating solutions for each layer were prepared as follows.

(First-layer Coating Solution)

24.1 g of a yellow coupler (EXCY-1), 6.8 g of a color-developing agent (EXCD-1), and 80 g of a solvent (Solv-1) were dissolved in ethyl acetate, and the resulting solution was emulsified and dispersed into a 16% gelatin solution containing 10% sodium dodecylbenzensulfonate and citric acid, to prepare an emulsified dispersion A. On the other hand, a silver chlorobromide emulsion A (cubes, a mixture of a large-size emulsion A having an average grain size of 0.88 $\mu$m, and a small-size emulsion A having an average grain size of 0.70 $\mu$m (3:7 in terms of mol of silver), the deviation coefficients of the grain size distributions being 0.08 and 0.10 respectively, and each emulsion having 0.3 mol % of silver bromide locally contained in part of the grain surface whose substrate was made up of silver chloride) was prepared. To the large-size emulsion A of this emulsion, had been added $1.4\times10^{-4}$ mol, per mol of silver, of each of blue-sensitive sensitizing dyes A, B, and C shown below, and to the small-size emulsion A of this emulsion, had been added $1.7\times10^{-4}$ mol, per mol of silver, of each of blue-sensitive sensitizing dyes A, B, and C shown below. The chemical ripening of this emulsion was carried out optimally with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

EXCD-1

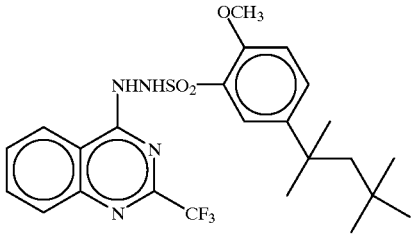

-continued

EXCY-1

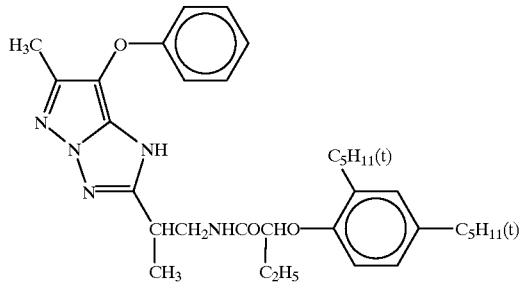

(Compound described in EP-A-545 491 (Al))

The coating solutions for the second layer to seventh layer were prepared in the similar manner as that for the first-layer coating solution. As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 50.0 mg/m$^2$, and 10.0 mg/m$^2$, respectively.

For the silver chlorobromide emulsion of each photosensitive emulsion layer, the following spectral sensitizing dyes were used.

(Blue-Sensitive Emulsion Layer)

Sensitizing dye A

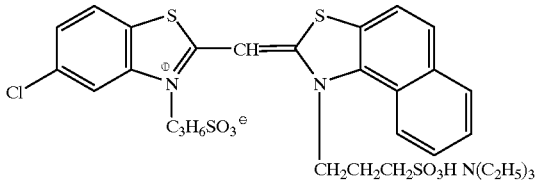

Sensitizing dye B

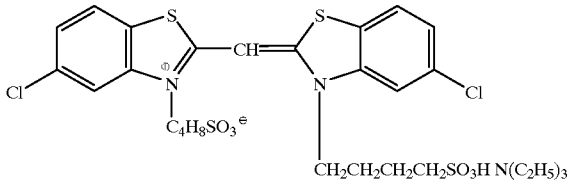

Sensitizing dye C

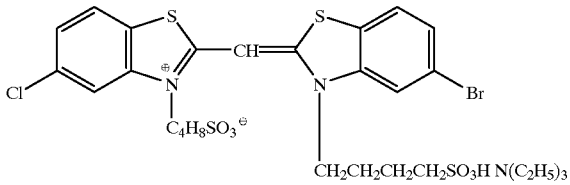

(Green-Sensitive Emulsion Layer)

Sensitizing dye D

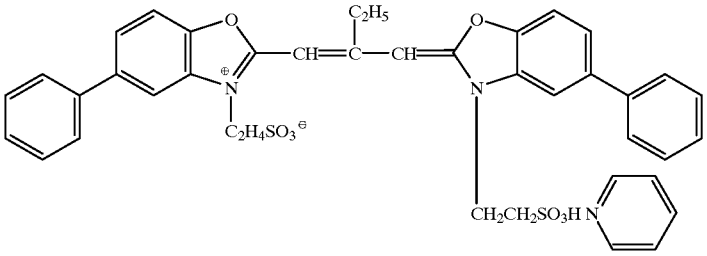

Sensitizing dye E

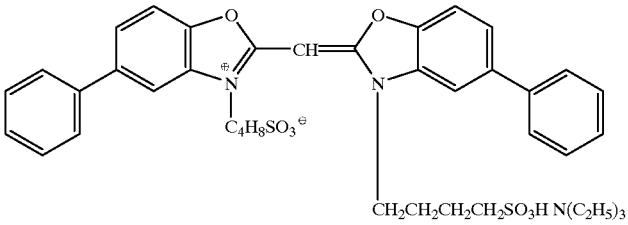

-continued

Sensitizing dye F

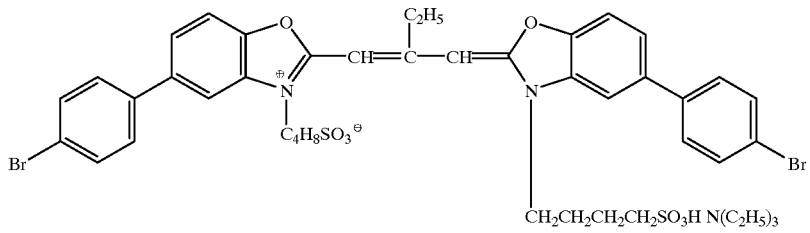

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

(Red-Sensitive Emulsion Layer)

Sensitizing dye G

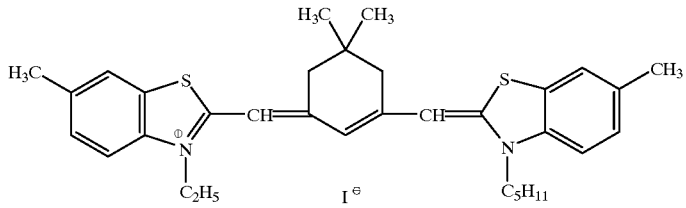

Sensitizing dye H

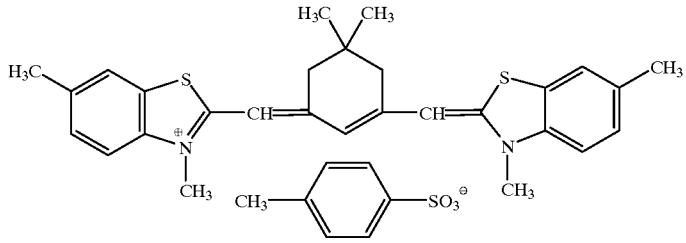

(Each was added to the large-size emulsion in an amount of $5.0\times10^{-5}$ mol per mol of the silver halide, and to the small-size emulsion in an amount of $8.0\times10^{-5}$ per mol of the silver halide.)

Further, the following compound (S) was added in an amount of $2.6\times10^{-2}$ mol per mol of the silver halide.

Further, to the blue-sensitive emulsion layer, the green-sensitive emulsion layer, and the red-sensitive emulsion layer, was added 1-(5-methylureidophenyl)-5-mercaptotetrazole in amounts of $3.5\times10^{-4}$ mol, $3.0\times10^{-3}$ mol, and $2.5\times10^{-4}$ mol, respectively, per mol of the silver halide.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to neutralize irradiation, the following dye was added to the emulsion layers (the coating amount is shown in parentheses).

Compound (5)

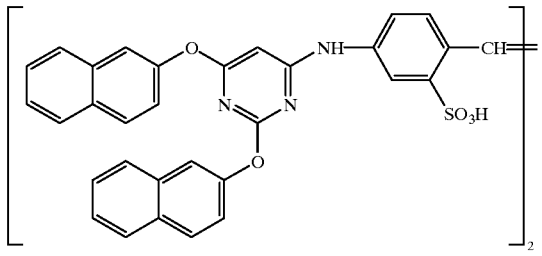

-continued

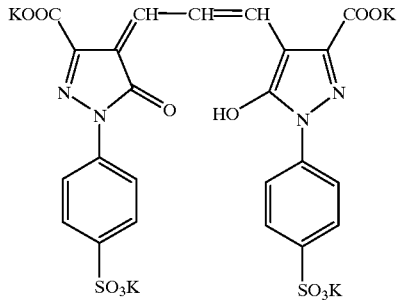

(10 mg/m$^2$)

and

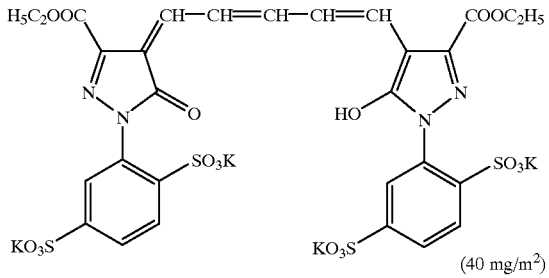

(40 mg/m$^2$)

(Layer Configuration)

The composition of each layer is shown below. The numbers show coating amounts (g/m$^2$). In the case of the silver halide emulsion, the coating amount is in terms of silver.

Base

Polyethylene-laminated Paper

[The polyethylene on the first layer side contained a white pigment ($TiO_2$:15 wt %) and a blue dye (ultramarine)]

| | |
|---|---|
| First Layer (Blue-Sensitive Emulsion Layer) | |
| The above silver chlorobromide emulsion A | 0.40 |
| Gelatin | 3.00 |
| Yellow coupler (EXCY-1) | 0.48 |
| Color-developing agent (EXCD-1) | 0.34 |
| Solvent (Solv-1) | 1.40 |
| Second Layer (Color-Mixing Inhibiting Layer) | |
| Gelatin | 1.09 |
| Color-mixing inhibitor (Cpd-6) | 0.11 |
| Solvent (Solv-1) | 0.19 |
| Solvent (Solv-3) | 0.07 |
| Solvent (Solv-4) | 0.25 |
| Solvent (Solv-5) | 0.09 |
| Third Layer (Green-Sensitive Emulsion Layer) | |
| A silver chlorobromide emulsion: cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.8 mol % of AgBr contained in part of the grain surface whose substrate was made up of silver chloride. | 0.20 |
| Gelatin | 1.50 |
| Magenta coupler (EXCM-1) | 0.28 |
| Color developing agent (EXCD-1) | 0.17 |
| Solvent (Solv-2) | 0.70 |
| Fourth Layer (Color-Mixing Inhibiting Layer) | |
| Gelatin | 0.77 |
| Color-mixing inhibitor (Cpd-6) | 0.08 |
| Solvent (Solv-1) | 0.14 |

-continued

| | |
|---|---|
| Solvent (Solv-3) | 0.05 |
| Solvent (Solv-4) | 0.14 |
| Solvent (Solv-5) | 0.06 |
| Fifth Layer (Red-Sensitive Emulsion Layer) | |
| A silver chlorobromide emulsion: cubes, a mixture of a large-size emulsion C having an average grain size of 0.5 μm, and a small-size emulsion C having an average grain size of 0.41 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride. | 0.20 |
| Gelatin | 0.15 |
| Cyan coupler (EXCC-1) | 0.24 |
| Color-developing agent (EXCD-1) | 0.17 |
| Solvent (Solv-1) | 0.70 |
| Sixth Layer (Ultraviolet Absorbing Layer) | |
| Gelatin | 0.64 |
| Ultraviolet absorbing agent (UV-1) | 0.39 |
| Color-image stabilizer (Cpd-7) | 0.05 |
| Solvent (Solv-6) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

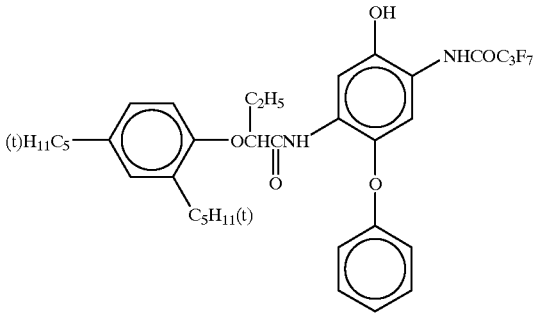

EXCM-1

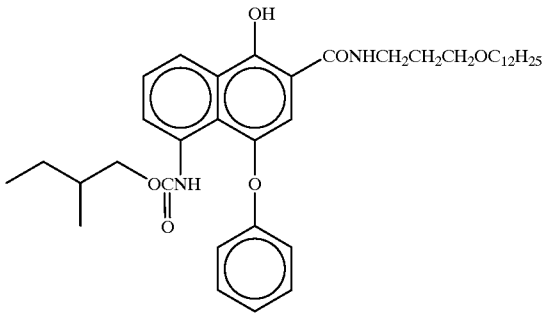

EXCC-1

(Cpd-1) Surface-active agent

7:3 mixture (by weight ratio) of

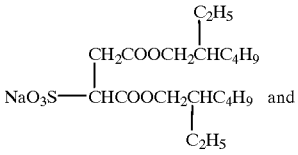

and

-continued
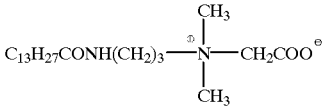
(Cpd-2) Antiseptic
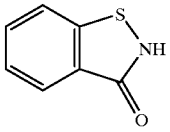
(Cpd-3) Antiseptic
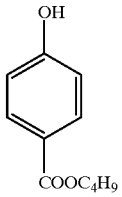
(Cpd-4) Antiseptic
1:1:1:1 mixture of a, b, c, d
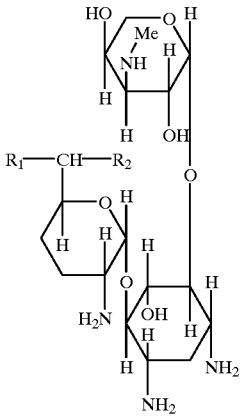
| | $R_1$ | $R_2$ |
|---|---|---|
| a | —Me | —NHMe |
| b | —Me | —$NH_2$ |
| c | —H | —$NH_2$ |
| d | —H | —NHMe |
(Cpd-5) Antiseptic
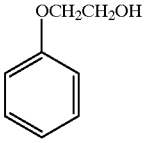
(Solv-1) Solvent
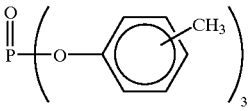
-continued
(Solv-2) Solvent
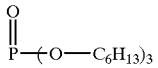
(Cpd-6) Color-mixing inhibitor
(1)
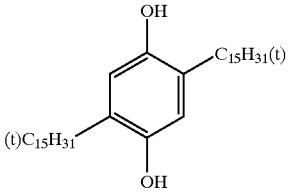
(2)
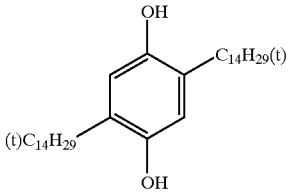
(3)
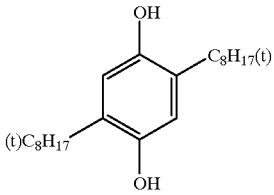
mixture (by weight ratio) of (1):(2):(3) = 1:1:1
(Cpd-7) Dye image stabilizer
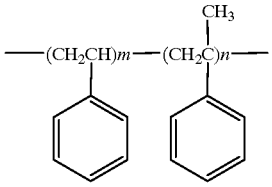
number-average molecular weight 600 m/n = 9/1
(Solv-3) Solvent
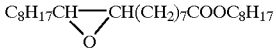
(Solv-4) Solvent
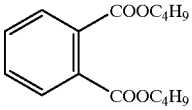
(Solv-5) Solvent
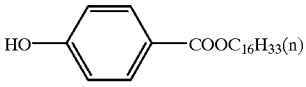

-continued (Solv-6) Solvent $C_8H_{17}OCO—(CH_2)_8—COOC_8H_{17}$ (UV-1) Ultraviolet Absorber (1)

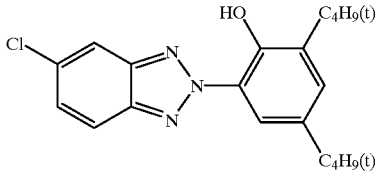

(2)

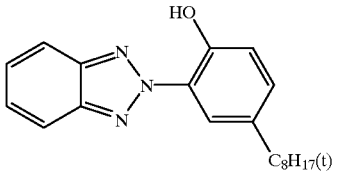

(3)

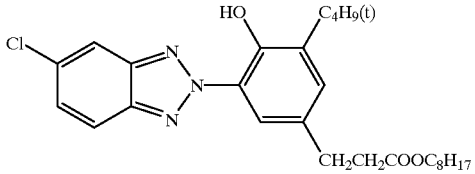

(4)

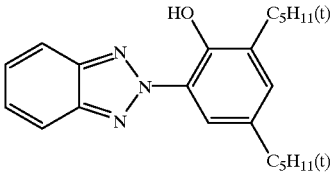

(5)

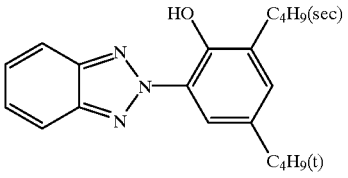

mixture (by weight ratio) of
(1):(2):(3):(4):(5) = 1:2:2:3:1

Samples (102) to (112) were prepared in the same manner as Sample (101), except that instead of the couplers and the color-developing agent, the couplers and the color-developing agents, shown in Table 1, were used, respectively, in the same molar amounts.

By using an FWH-type sensitometer (color temperature of the light source: 3,200° K), manufactured by Fuji Photo Film Co., Ltd., gradation exposure was given to all of the thus prepared Samples through a three-color separation filter for sensitometry.

The thus exposed Samples were processed with the following processing solutions in the following processing steps:

| Processing step | Temperature | Time |
|---|---|---|
| Development | 40° C. | 15 sec |
| Bleach-fix | 40° C. | 45 sec |
| Rinse | room temperature | 45 sec |
| Alkali processing | room temperature | 30 sec |

(Developing Solution)

| | |
|---|---|
| Water | 800 ml |
| Potassium phosphate | 40 g |
| Disodium N,N-bis (sulfonatoethyl)hydroxylamine | 10 g |
| KCl | 5 g |
| Hydroxylethylidene-1,1-disulfonic acid (30%) | 4 ml |
| 1-phenyl-4-methyl-4-hydroxymethyl-3-pyrazolidone | 1 g |
| Water, to make | 1,000 ml |
| pH (at 25° C. by using potassium hydroxide) | 12.0 |

(Bleach-fix Solution)

| | |
|---|---|
| Water | 600 ml |
| Ammonium thiosulfate (700 g/liter) | 93 ml |
| Ammonium sulfite | 40 ml |
| Ethylenediaminetetraacetic acid iron(III) ammonium salt | 55 g |
| Ethylenlediamintetraacetic acid | 2 g |
| Nitric acid (67%) | 30 g |
| Water to make | 1,000 ml |
| pH (at 25° C. by using acetic acid and ammonia water) | 5.8 |

(Rinsing Solution)

| | |
|---|---|
| Sodium chlorinated-isocyanurate | 0.02 g |
| Deionized water (conductivity: 5 μS/cm or below) | 1,000 ml |
| pH | 6.5 |

(Alkali Processing Solution)

| | |
|---|---|
| Water | 800 ml |
| Potassium cabonate | 30 g |
| Water to make | 1,000 ml |
| pH (at 25° C. by using sulfuric acid) | 10.0 |

The maximum color density (Dmax) parts of the processed Samples were measured using red light, green light, and blue light. The results are shown in Table 1.

TABLE 1

| Sample No. | Yellow coupler | Magenta coupler | Cyan coupler | Color-developing agent | Yellow Dmax | Magenta Dmax | Cyan Dmax | Remarks |
|---|---|---|---|---|---|---|---|---|
| 101 | EXCY-1 | EXCM-1 | EXCC-1 | EXCD-1 | 0.25 | 0.21 | 0.24 | Comparative example |
| 102 | EXCY-1 | EXCM-1 | EXCC-1 | (I-16) | 1.12 | 0.75 | 1.20 | Comparative example |
| 103 | EXCY-1 | EXCM-1 | EXCC-1 | (I-1) | 1.21 | 1.05 | 0.84 | Comparative example |
| 104 | (C-21) | (C-40) | (C-43) | EXCD-1 | 0.28 | 0.30 | 0.26 | Comparative example |

TABLE 1-continued

| Sample No. | Yellow coupler | Magenta coupler | Cyan coupler | Color-developing agent | Yellow Dmax | Magenta Dmax | Cyan Dmax | Remarks |
|---|---|---|---|---|---|---|---|---|
| 105 | (C-21) | (C-40) | (C-43) | (I-16) | 1.40 | 1.38 | 1.35 | This invention |
| 106 | (C-24) | (C-37) | (C-57) | (I-16) | 1.56 | 1.50 | 1.47 | This invention |
| 107 | (C-46) | (C-29) | (C-41) | (I-1) | 1.65 | 1.28 | 1.44 | This invention |
| 108 | (C-47) | (C-28) | (C-44) | (I-1) | 1.80 | 1.38 | 1.52 | This invention |
| 109 | (C-21) | (C-40) | (C-43) | (I-36) | 1.35 | 1.14 | 1.31 | This invention |
| 110 | (C-24) | (C-37) | (C-57) | (I-36) | 1.40 | 1.20 | 1.40 | This invention |
| 111 | (C-21) | (C-40) | (C-43) | (I-32) | 1.72 | 1.32 | 1.38 | This invention |
| 112 | (C-24) | (C-37) | (C-57) | (I-32) | 1.81 | 1.45 | 1.51 | Thin invention |

As is apparent from the results shown in Table 1, the combination of the color-developing agent and the coupler for use in the present invention exhibited remarkably high color-forming property.

Example 2

<Preparation Method of Light-sensitive Silver Halide Emulsion>

To a well-stirred aqueous gelatin solution (containing 30 g of inert gelatin and 2 g of potassium bromide in 1,000 ml of water), were added ammonia.ammonium nitrate as a solvent for silver halide, the temperature was kept at 75° C., and then 1000 ml of an aqueous solution containing 1 mol of silver nitrate, and 1,000 ml of an aqueous solution containing 1 mol of potassium bromide and 0.03 mol of potassium iodide, were simultaneously added thereto, over 78 min. After washing with water and desalting, inert gelatin was added, for redispersion, thereby preparing a silver iodobromide emulsion having a diameter of the grain volume, which is assumed to be a sphere, of 0.76 $\mu$m, and an iodine content of 3 mol %. The diameter of the grain volume, which is assumed to be a sphere, was measured by a Model TA-II, manufactured by Coulter Counter Co.

To the above emulsion were added potassium thiocyanate, chloroauric acid, and sodium thiosulfate, at 56° C., to achieve optimal chemical sensitization. To this emulsion, each sensitizing dye corresponding to each of the spectral sensitivities was added at the time of preparation of the coating solution, to provide color sensitivities.

<Preparation Method of Zinc Hydroxide Dispersion>

31 g of zinc hydroxide powder, whose primary particles had a grain size of 0.2 $\mu$m, 1.6 g of carboxylmethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

<Preparation Method of Emulsified Dispersion of Coupler>

The oil-phase components and the aqueous-phase components of each composition shown in Table 2 were dissolved, respectively, to obtain uniform solutions at 60° C. The oil-phase components and the aqueous-phase components were combined together and were dispersed in a 1-liter stainless steel vessel, by a dissolver equipped with a disperser having a diameter of 5 cm, at 10,000 rpm for 20 min. Warm water (as an additional water) was added thereto in the amount shown in Table 2, followed-by stirring at 2,000 rpm for 10 min. Thus, emulsified dispersions containing one of three couplers, that is, cyan, magenta, and yellow couplers, were prepared, respectively.

TABLE 2

| | | Cyan | Magenta | Yellow |
|---|---|---|---|---|
| Oil phase | Cyan coupler (1) | 5.63 g | — | — |
| | Magenta coupler (2) | — | 6.57 g | — |
| | Yellow coupler (3) | — | — | 6.55 g |
| | Developing agent (4) | 5.11 g | 5.11 g | 5.11 g |
| | Antifoggant (5) | 3.0 mg | 1.0 mg | 10.0 mg |
| | High-boiling solvent (6) | 6.69 g | 5.52 g | 4.77 g |
| | Ethyl acetate | 24.0 ml | 24.0 ml | 24.0 ml |
| Aqueous phase | Lime-processed gelatin | 12.0 g | 12.0 g | 12.0 g |
| | Surface-active agent (7) | 0.60 g | 0.60 g | 0.60 g |
| | Water | 138.0 ml | 138.0 ml | 138.0 ml |
| | Additional water | 180.0 ml | 180.0 ml | 180.0 ml |

Cyan coupler (1)

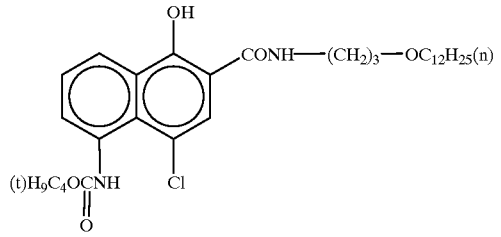

Magenta coupler (2)

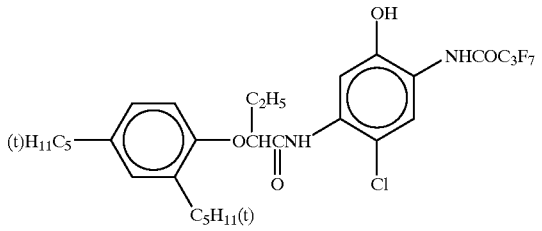

Yellow coupler (3)

TABLE 2-continued

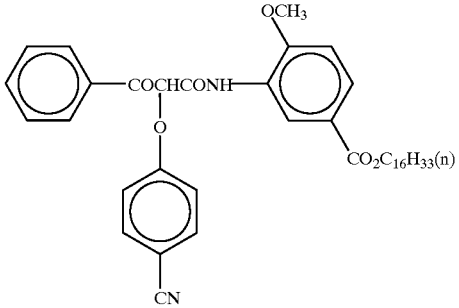

Developing agent (4)

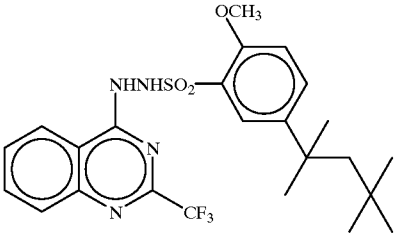

(Compound described in EP-A-545 491 (A1))
Antifoggant (5)

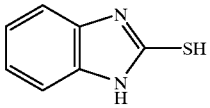

High-boiling solvent (6)

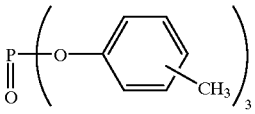

Surface-active agent (7)

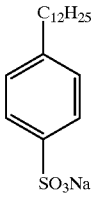

By using the thus obtained materials, a heat-development color light-sensitive material 201, having the multi-layer configuration shown in Table 3, was prepared.

TABLE 3

Constitution of light-sensitive material 201

| Layer Configuration | Additive | Added amount (mg/m$^2$) |
|---|---|---|
| Seventh layer protective layer | Lime-processed gelatin | 1000 |
| | Matting agent (silica) | 50 |
| | Surface-active agent (8) | 100 |

TABLE 3-continued

Constitution of light-sensitive material 201

| | | |
|---|---|---|
| | Surface-active agent (9) | 300 |
| | Water-soluble polymer (10) | 15 |
| Sixth layer Interlayer | Lime-processed gelatin | 375 |
| | Surface-active agent (9) | 15 |
| | Zinc hydroxide | 1130 |
| | Water-soluble polymer (10) | 15 |
| Fifth layer Yellow color-forming layer | Lime-processed gelatin | 1450 |
| | Light-sensitive silver halide emulsion (in terms of silver) | 692 |
| | Sensitizing dye (12) | 3.65 |
| | Yellow coupler (3) | 524 |
| | Developing agent (4) | 409 |
| | Antifoggant (5) | 0.8 |
| | High-boiling solvent (6) | 382 |
| | Surface-active agent (7) | 48 |
| | Water-soluble polymer (10) | 20 |
| Forth layer Interlayer | Lime-processed gelatin | 1000 |
| | Surface-active agent (9) | 8 |
| | Water-soluble polymer (10) | 5 |
| | Hardener (11) | 65 |
| Third layer Magenta color-forming layer | Lime-processed gelatin | 993 |
| | Light-sensitive silver halide emulsion (in terms of silver) | 475 |
| | Sensitizing dye (13) | 0.07 |
| | Sensitizing dye (14) | 0.71 |
| | Sensitizing dye (15) | 0.19 |
| | Magenta coupler (2) | 361 |
| | Developing agent (4) | 281 |
| | Antifoggant (5) | 0.06 |
| | High-boiling solvent (6) | 304 |
| | Surface-active agent (7) | 33 |
| | Water-soluble polymer (10) | 14 |
| Second layer Interlayer | Lime-processed gelatin | 1000 |
| | Surface-active agent (9) | 8 |
| | Zinc hydroxide | 1130 |
| | Water-soluble polymer (10) | 5 |
| First layer Cyan color-forming layer | Lime-processed gelatin | 720 |
| | Light-sensitive silver halide emulsion (in terms of silver) | 346 |
| | Sensitizing dye (16) | 1.52 |
| | Sensitizing dye (17) | 1.03 |
| | sensitizing dye (18) | 0.05 |
| | Cyan coupler (1) | 225 |
| | Developing agent (4) | 205 |
| | Antifoggant (5) | 0.12 |
| | High-boiling solvent (6) | 268 |
| | Surface-active agent (7) | 24 |
| | Water-soluble polymer (10) | 10 |
| | Transparent PET base (102 μm) | |

Surface-active agent (8)

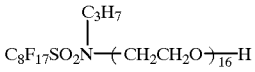

Surface-active agent (9)

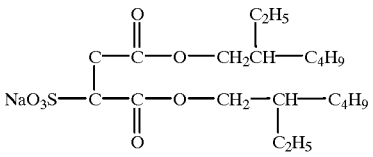

Water-soluble polymer (10)

TABLE 3-continued

Constitution of light-sensitive material 201

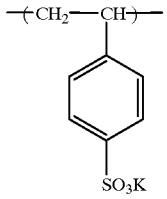

Hardner (11) $CH_2{=}CH{-}SO_2{-}CH_2{-}SO_2{-}CH{=}CH_2$

Sensitizing dye (12)

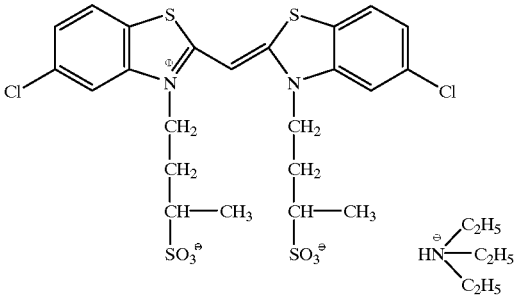

Sensitizing dye (13)

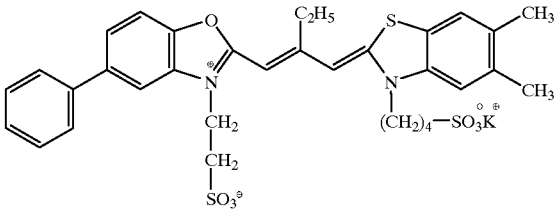

Sensitizing dye (14)

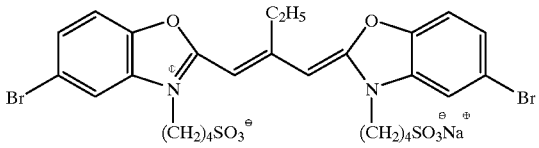

Sensitizing dye (15)

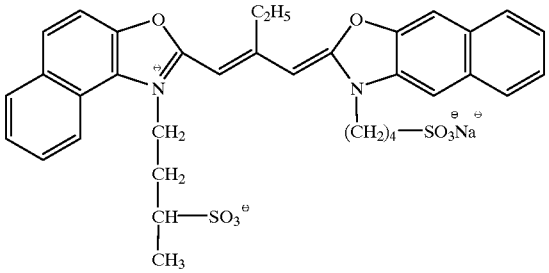

Sensitizing dye (16)

TABLE 3-continued

Constitution of light-sensitive material 201

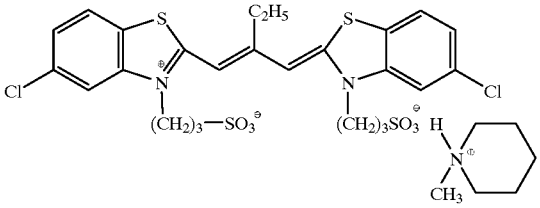

Sensitizing dye (17)

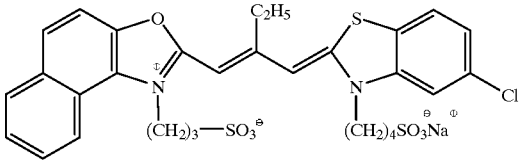

Sensitizing dye (18)

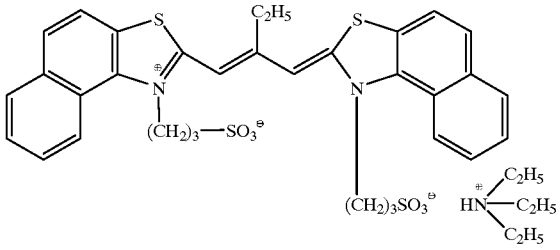

Further, Processing Material R-1, having the contents shown in Tables 4 and 5, was prepared.

TABLE 4

Constitution of processing material R-1

| Layer Configuration | Addivtive | Added amount ($mg/m^2$) |
|---|---|---|
| Forth layer | Acid-processed gelatin | 220 |
| Protective layer | Water-soluble polymer (19) | 60 |
| | Water-soluble polymer (20) | 200 |
| | Additive (21) | 80 |
| | Palladium sulfide | 3 |
| | Potassium nitrate | 12 |
| | Matting agent (22) | 10 |
| | Surface-active agent (9) | 7 |
| | Surface-active agent (23) | 7 |
| | Surface-active agent (24) | 10 |
| Third layer | Lime-processed gelatin | 240 |
| Interlayer | Water-soluble polymer (20) | 24 |
| | Hardener (25) | 180 |
| | Surface-active agent (7) | 9 |
| Second layer | Lime-processed gelatin | 2400 |
| Base-producing | Water-soluble polymer (20) | 360 |
| layer | Water-soluble polymer (26) | 700 |
| | Water-soluble polymer (27) | 600 |
| | High-boiling solvent (28) | 2000 |
| | Additive (29) | 20 |
| | Potassium hydantoinate | 260 |
| | Guanidine picolinate | 2910 |
| | Potassium quinolinate | 225 |
| | Sodium quinolinate | 180 |
| | Surface-active agent (7) | 24 |
| First layer | Lime-processed gelatin | 280 |

TABLE 4-continued

Constitution of processing material R-1

| Layer Configuration | Addivtive | Added amount (mg/m$^2$) |
|---|---|---|
| Undercoat layer | Water-soluble polymer (19) | 12 |
| | Surface-active agent (9) | 14 |
| | Hardener (25) | 185 |
| | Transparent base A (63 $\mu$m) | |

TABLE 5

Constitution of Base A

| Name of layer | Composition | Weight (mg/m$^2$) |
|---|---|---|
| Undercoat layer surface | Lime-processed gelatin | 100 |
| Polymer layer | Polyethylene terephthalate | 62500 |
| Undercoat layer of back surface | Polymer (Methyl methacrylate/ styrene/2-ethylhexyl acrylate/ methacrylic acid copolymer | 1000 |
| | PMMA latex | 120 |

Water-soluble polymer (19) (kappa)

κ-Carrageenan

Water-soluble polymer (20) Sumikagel L-5H (trade name: manufactured by Sumitomo Kagaku Co.)

Additive (21)

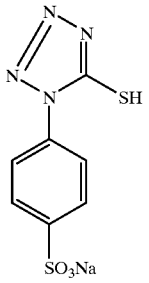

Matting agent (22) SYLOID79 (trade name: manufactured by Fuji Davisson Co.)

Surface-active agent (23)

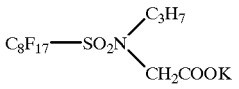

Surface-active agent (24)

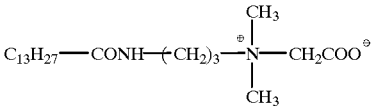

TABLE 5-continued

Constitution of Base A

Hardner (25)

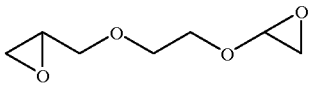

Water-soluble polymer (26) Dextran (molecular weight 70,000)

Water-soluble-polymer (27) MP polymer MP102 (trade name: manufactured by Kurare Co.)

High-boiling solvent (28) EMPARA 40 (trade name: manufactured by Ajinomoto K.K.)

Additive (29)

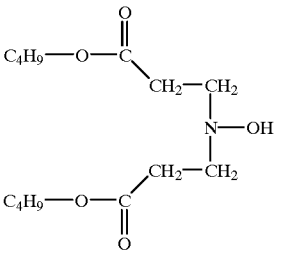

Further, Light-sensitive materials 202 to 212 were prepared in the same manner as in Light-sensitive material 201, except that the coupler and the developing agent were changed as shown in Table 6. The thus prepared Light-sensitive materials 201 to 212 were exposed to light at 2,500 lux for 0.01 sec through B, G, or R filter, whose density was respectively changed continuously. Warm water at 40° C. was applied to the surface of the thus exposed light-sensitive materials, in an amount of 15 ml/m$^2$, and then after each processing sheet (image-receiving material) and each film surface were brought together, they were subjected to heat development at 80° C. for 30 sec using a heat dram. After the processing, when the image-receiving material was removed, cyan, magenta, and yellow color images were obtained clearly on the side of the light-sensitive material corresponding to the filters used for the exposure. Immediately after the processing, for each Samples, the maximum density (Dmax) parts and the minimum density (Dmin) parts of yellow dye-image of B exposed part, magenta image of G exposed part, and cyan image of R exposed part were measured by an X-rite densitometer. The results are shown in Table 7.

TABLE 6

| Sample No. | Yellow coupler (coating amount) | Developing agent (coating amount) | Magenta coupler (coating amount) | Developing agent (coating amount) | Cyan coupler (coating amount) | Developing agent (coating amount) |
|---|---|---|---|---|---|---|
| 201 | (3) | (4) | (2) | (4) | (1) | (4) |
| (Comparative example) | (0.8) | (0.8) | (0.55) | (0.55) | (0.4) | (0.4) |
| 202 | (3) | (4) | (2) | (4) | (1) | (4) |
| (Comparative example) | (1.6) | (0.8) | (1.1) | (0.55) | (0.8) | (0.4) |
| 203 | (3) | (4) | (2) | (4) | (1) | (4) |
| (Comparative example) | (0.8) | (1.6) | (0.55) | (1.1) | (0.4) | (0.8) |
| 204 | C-21 | (4) | C-40 | (4) | C-43 | (4) |
| (Comparative example) | (0.8) | (0.8) | (0.55) | (0.55) | (0.4) | (0.4) |
| 205 | (3) | I-16 | (2) | I-16 | (1) | I-16 |
| (Comparative example) | (0.8) | (0.8) | (0.55) | (0.55) | (0.4) | (0.4) |
| 206 | C-21 | I-16 | C-40 | I-16 | C-43 | I-16 |
| (This invention) | (0.8) | (0.8) | (0.55) | (0.55) | (0.4) | (0.4) |
| 207 | C-24 | I-16 | C-37 | I-16 | C-57 | I-16 |
| (This invention) | (0.8) | (0.8) | (0.55) | (0.55) | (0.4) | (0.4) |
| 208 | C-46 | I-1 | C-29 | I-1 | C-41 | I-1 |
| (This invention) | (0.8) | (0.8) | (0.55) | (0.55) | (0.4) | (0.4) |
| 209 | C-21 | I-36 | C-28 | I-1 | C-44 | I-1 |
| (This invention) | (0.8) | (0.8) | (0.55) | (0.55) | (0.4) | (0.4) |
| 210 | C-24 | I-36 | C-40 | I-36 | C-57 | I-36 |
| (This invention) | (0.8) | (0.8) | (0.55) | (0.55) | (0.4) | (0.4) |
| 211 | C-21 | I-32 | C-40 | I-32 | C-43 | I-32 |
| (This invention) | (0.8) | (0.8) | (0.55) | (0.55) | (0.4) | (0.4) |
| 212 | C-24 | I-32 | C-37 | I-32 | C-57 | I-32 |
| (This invention) | (0.8) | (0.8) | (0.55) | (0.55) | (0.4) | (0.4) |

Note:
The coating amount is represented in mmol/$m^2$.

TABLE 7

| Sample | Yellow | | Magenta | | Cyan | |
|---|---|---|---|---|---|---|
| No. | Dmax | Dmin | Dmax | Dmin | Dmax | Dmin |
| 201 (Comparative example) | 0.50 | 0.20 | 0.52 | 0.21 | 0.40 | 0.22 |
| 202 (Comparative example) | 0.53 | 0.21 | 0.55 | 0.18 | 0.48 | 0.20 |
| 203 (Comparative example) | 0.54 | 0.23 | 0.60 | 0.24 | 0.51 | 0.24 |
| 204 (Comparative example) | 0.58 | 0.20 | 0.63 | 0.23 | 0.59 | 0.21 |
| 205 (Comparative example) | 1.20 | 0.25 | 1.27 | 0.21 | 1.32 | 0.18 |
| 206 (This invention) | 1.48 | 0.20 | 1.42 | 0.23 | 1.52 | 0.24 |
| 207 (This invention) | 1.52 | 0.21 | 1.56 | 0.20 | 1.60 | 0.21 |
| 208 (This invention) | 1.39 | 0.23 | 1.52 | 0.24 | 1.73 | 0.20 |
| 209 (This invention) | 1.43 | 0.19 | 1.60 | 0.21 | 1.68 | 0.22 |
| 210 (This invention) | 1.55 | 0.23 | 1.71 | 0.19 | 1.62 | 0.25 |
| 211 (This invention) | 1.46 | 0.20 | 1.55 | 0.23 | 1.71 | 0.21 |
| 212 (This invention) | 1.70 | 0.24 | 1.62 | 0.20 | 1.90 | 0.24 |

As is apparent from the results shown in Table 7, it can be understood that the combinations of developing agents with couplers according to the present invention gave remarkably high maximum densities with minimum densities scarcely varied, to give excellent discrimination. Further, the above light-sensitive materials were processed in the same manner, except that the temperature of the heat drum was adjusted to bring the temperature of the film surface to 75° C. or 85° C. As a result, it can be understood that the method wherein the color-developing agents and the couplers for use in the present invention were used, made conspicuously small the difference in color density and was very low in development-temperature dependence.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for forming an image, comprising exposing a silver halide photographic light-sensitive material to light, and subjecting the silver halide photographic light-sensitive material to development, wherein the said silver halide photographic light-sensitive material has at least one photographic constitutional layer on a base, and wherein one or more of the said photographic constitutional layers contains at least one color-developing agent represented by formula (I) and at least one dye-forming coupler represented by formula (II) in the same layer or different layers: formula (I)

formula (I)

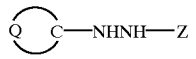

wherein Z represents a carbamoyl group, an acyl group, a sulfamoyl group, an alkoxycarbonyl group, an aryloxycarbonyl group, an amidino group, or an imidoyl group, and Q represents a group of atoms required to form an unsaturated ring together with the C, $$(Y')_n—M—G—(Y^2)_m$$ formula (II)

wherein M represents a coupler component capable of causing coupling reaction at the site where G is bonded with the oxidization product of the color-developing agent represented by formula (I), G represents a hydrogen atom or a group capable of coupling split-off by the coupling reaction with the oxidization product of the color-developing agent represented by formula (I), $Y^1$ and $Y^2$ each represent a group having a dissociation group, whose pKa is 1 or more but 12 or less, n and m are each an integer of 0 to 3, provided that $n+m \geqq 1$, and when n and m are each 2 or more, $Y^1$'s and $Y^2$'s are each the same or different.

2. The method for forming an image as claimed in claim 1, wherein the said silver halide photographic light-sensitive material is subjected to development by heating at 60° C. or higher but 180° C. or lower.

3. The method for forming an image as claimed in claim 1, wherein the said silver halide photographic light-sensitive material is subjected to development in a solution.

4. The method for forming an image as claimed in claim 3, wherein the development is carried out by using an alkaline processing solution containing no color-developing agent.

5. The method for forming an image as claimed in claim 1, wherein, in formula (I), Z represents a carbamoyl group, and in formula (II), $Y^1$ and $Y^2$ each represent a group having a dissociation group selected from the group consisting of a —COOH group, an —$NHSO_2$— group, a phenolic hydroxyl group, a —CONHCO— group, a —$CONHSO_2$— group, and an —$SO_2NHSO_2$— group, in which the pKa is 3 or more but 12 or less.

6. The method for forming an image as claimed in claim 5, wherein, in formula (II), m is 1 or 2.

7. The method for forming a image as claimed in claim 1, wherein, in formula (II), n+m is 2 or more.

8. The method for forming an image as claimed in claim 1, wherein in formula (I), Z represents a carbamoyl group.

9. The method for forming an image as claimed in claim 2, wherein in formula (I), Z represents a carbamoyl group.

10. The method for forming an image as claimed in claim 8, wherein the carbamoyl group is represented by —$CONHR_{11}$, in which $R_{11}$ represents a hydrogen atom, an alkyl group, an aryl group, a heterocyclic group, an alkoxy group, an amido group, or an imido group.

11. The method for forming an image as claimed in claim 9, wherein the carbamoyl group is represented by —$CONHR_{11}$, in which $R_{11}$ represents a hydrogen atom, an alky group, an aryl group, a heterocyclic group, an alkoxy group, an amido group, or an imido group.

12. The method for forming an image as claimed in claim 1, wherein the unsaturated ring formed by Q and the C is an aromatic hydrocarbon ring or an unsaturated heterocyclic ring.

13. The method for forming an image as claimed in claim 2, wherein the unsaturated ring formed by Q and the C is an aromatic hydrocarbon ring or an unsaturated heterocyclic ring.

14. The method for forming an image as claimed in claim 12, wherein the aromatic hydrocarbon ring and the unsaturated heterocyclic ring have as a substituent at least one electron-attracting group.

15. The method for forming an image as claimed in claim 13, wherein the aromatic hydrocarbon ring and the unsaturated heterocyclic ring have as a substituent at least one electron-attracting group.

16. The method for forming an image as claimed in claim 1, wherein the unsaturated ring formed by Q and the C is an aromatic hydrocarbon ring substituted with at least one electron-attracting group, so that the sum of Hammett substituent constant σp values of the substituents on the aromatic hydrocarbon ring would be 0.8 or a more but 3.5 or less, an unsaturated heterocyclic ring, or condensed ring formed by these.

17. The method for forming an image as claimed in claim 2, wherein the unsaturated ring formed by Q and the C is an aromatic hydrocarbon ring substituted with at least on electron-attracting group, so that the sum of Hammett substituent constant σp values of the substituents on the aromatic hydrocarbon ring would be 0.8 or more but 3.5 or less, an unsaturated heterocyclic ring, or a condensed ring formed by these.

18. The method for forming an image as claimed in claim 1, wherein, in formula (II), $Y^1$ and $Y^2$, which are the same or different, each represent a group having a —COOH group, an —$NHSO_2$— group, a phenolic hydroxyl group, a —CONHCO— group, a —$CONHSO_2$— group, a —CON(R)—OH group, in which R represents a hydrogen atom or a substituent, or a —COOH or —$SO_2NHSO_2$— group.

19. The method for forming an image as claimed in claim 2, wherein, in formula (II), $Y^1$ and $Y^2$, which are the same or different, each represent a group having a —COOH group, an —$NHSO_2$— group, a phenolic hydroxyl group, a —CONHCO— group, a —$CONHSO_2$— group, a —CON(R)—OH group, in which R represents a hydrogen atom or a substituent, or a —COOH or —$SO_2NHSO_2$— group.

20. The method for forming an image as claimed in claim 18, wherein, in formula (II), $Y^1$ and $Y^2$ each represent a group having a dissociation group selected from the group consisting of a —COOH group, an —$NHSO_2$— group, a phenolic hydroxyl group, a —CONHCO— group, a —$CONHSO_2$— group, and an —$SO_2NHSO_2$— group, in which the pKa is 3 or more but 12 or less.

21. The method for forming an image as claimed in claim 19, wherein, in formula (II), $Y^1$ and $Y^2$ each represent a group having a dissociation group selected from the group consisting of a —COOH group, an —$NHSO_2$— group, a phenolic hydroxyl group, a —CONHCO— group, a —$CONHSO_2$— group, and an —$SO_2NHSO_2$— group, in which the pKa is 3 or more but 12 or less.

22. The method for forming an image as claimed in claim 2, wherein, in formula (I), Z represents a carbamoyl group, and in formula (II), $Y^1$ and $Y^2$ each represent a group having a dissociation group selected from the group consisting of a —COOH group, an —$NHSO_2$— group, a phenolic hydroxyl group, a —CONHCO— group, a —$CONHSO_2$— group, and an —$SO_2NHSO_2$— group, in which the pKa is 3 or more but 12 or less.

23. The method for forming an image as claimed in claim 22, wherein, in formula (II), m is 1 or 2.

24. The method for forming an image as claimed in claim 2, wherein, in formula (II), n+m is 2 or more.

25. The method for forming an image as claimed in claim 1, wherein, in formula (II), G is a halogen atom, an aryloxy group, a heterocyclic oxy group, an acyloxy group, an aryloxycarbonyloxy group, an alkoxycarbonyloxy group, or a carbamoyloxy group.

26. The method for forming an image as claimed in claim 2, wherein, in formula (II), G is a halogen atom, an aryloxy group, a heterocyclic oxy group, an acyloxy group, an aryloxycarbonyloxy group, an alkoxycarbonyloxy group, or a carbamoyloxy group.

27. The method for forming an image as claimed in claim 1, wherein the said at least one color-developing agent and the said at least one dye-forming coupler are contained in the same silver halide emulsion layer provided on a base of the said silver halide photographic light-sensitive material.

28. The method for forming an image as claimed in claim 2, wherein the said at least one color-developing agent and the said at least one dye-forming coupler are contained in the same silver halide emulsion layer provided on a base of the said silver halide photographic light-sensitive material.

29. The method for forming an image as claimed in claim 1, wherein, in formula (II), m is 1 to 3.

30. The method for forming an image as claimed in claim 2, wherein, in formula (II), m is 1 to 3.

* * * * *